US008090134B2

(12) United States Patent
Takigawa et al.

(10) Patent No.: US 8,090,134 B2
(45) Date of Patent: Jan. 3, 2012

(54) EARPHONE DEVICE, SOUND TUBE FORMING A PART OF EARPHONE DEVICE AND SOUND GENERATING APPARATUS

(75) Inventors: Souichi Takigawa, Hamamatsu (JP); Yoshikatsu Matsubara, Hamamatsu (JP); Tsuneyasu Demukai, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 383 days.

(21) Appl. No.: 12/491,390

(22) Filed: Jun. 25, 2009

(65) Prior Publication Data

US 2010/0061582 A1 Mar. 11, 2010

(30) Foreign Application Priority Data

Sep. 11, 2008 (JP) ..... 2008-233299

(51) Int. Cl.
*H04R 25/00* (2006.01)

(52) U.S. Cl. ..... 381/373; 381/372; 381/382

(58) Field of Classification Search ..... 381/309, 381/71.6, 328, 370, 371, 372, 373, 380, 382; 181/129, 130, 135; 379/430, 431
See application file for complete search history.

(56) References Cited

U.S. PATENT DOCUMENTS

| | | | | |
|---|---|---|---|---|
| 6,549,635 | B1 | 4/2003 | Gebert | |
| 7,391,878 | B2 * | 6/2008 | Liao | 381/370 |
| 2005/0105755 | A1 * | 5/2005 | Yueh | 381/371 |
| 2007/0177753 | A1 * | 8/2007 | Weinans et al. | 381/373 |

FOREIGN PATENT DOCUMENTS

| | | |
|---|---|---|
| DE | 102006008044 | 5/2007 |
| JP | 3-117995 | 12/1991 |
| WO | WO-2007-054589 A2 | 5/2007 |
| WO | WO-2007-085307 A1 | 8/2007 |

* cited by examiner

*Primary Examiner* — Huyen D Le
(74) *Attorney, Agent, or Firm* — Dickstein Shapiro LLP

(57) ABSTRACT

An insert earphone device includes an electro-acoustic device, an inserting body, a sound tube connected between the electro-acoustic device and the inserting body and an active valve unit provided on the sound tube, the sound tube is formed with a sound propagation path open at both ends thereof to the electro-acoustic device and the inserting body and an external sound entrance open at both end thereof to environment and the sound propagation path, and the active valve unit is formed of electroactive polymer and responsive to voltage supplied through a cable so as to close and open the external sound entrance; when a user wishes to hear external sound, the user changes the polarity of voltage so that the active valve unit is deformed for conducting the environment to the sound propagation path, whereby the user hears the external sound without removing the earphone device from the ear.

20 Claims, 11 Drawing Sheets

EARPHONE DEVICE, SOUND TUBE FORMING A PART OF EARPHONE DEVICE AND SOUND GENERATING APPARATUS

FIELD OF THE INVENTION

This invention relates to an earphone and, more particularly, to an earphone permitting user to hear environmental sound or human voice without removal from the user, a sound tube forming a part of the earphone device and a sound generating apparatus equipped with the earphone.

DESCRIPTION OF THE RELATED ART

The various models of earphone devices are known to users. One of the models of earphone devices is called as insert earphone devices. When users wish to hear sound converted from audio signals, they insert the insert earphone devices into their external auditory meatuses. The insert earphone device includes an insertion ear pad, an audio signal-to-sound converter and a cable. The insertion ear pad is formed with small holes, and the small holes are open to inner chambers of the insertion ear pad and the outside of insertion ear pad. The audio signal-to-sound converter is connected to the insertion ear pad, and the cable is connected between the audio signal-to-sound converter and a sources of audio signal such as, for example, a hearing aid, a telephone receiver or a sound reproduction apparatus. Sound is propagated through the inner chamber of insertion ear pad, and radiated through the small holes.

When the user wishes to hear music, news and etc. through the insert earphone device, he or she inserts the insertion ear pad into his or her external auditory meatus. Then, the insertion ear pad is snugly received in the external auditory meatus, and the small holes are directed to the ear drum through the external auditory meatus. The user turns on the source of audio signal. Then, the audio signal is supplied from the source to the audio signal-to-sound converter, and is converted to sound by means of the audio signal-to-sound converter. The sound passes through inner chamber of insertion ear pad, and enters the external auditory meatus through the small holes. The sound is propagated through the air in the external auditory meatus, and gives rise to the vibrations of ear drum. Another model of earphones is provided to the users in the form of headphones.

While the user is taking on the earphone devices, it is hard to hear the environmental sound, because the insertion ear pad is snugly received in the external auditory meatus of the user. Even if another person tries to talk to the user, the user does not notice the person trying to talk to him or her, immediately. It is inconvenient to him or her.

A countermeasure is proposed in Japan Utility Model Application laid-open No. Hei 3-117995. The prior art insert earphone device is of the type being inserted into the external auditory meatus. The insertion ear pad of the prior art insert earphone device is formed with not only the small holes to be directed to the ear drum but also an additional small hole, and the additional small hole is formed at the back of the audio signal-to-sound converter. When a user inserts the insertion ear pad into the external auditory meatus, the small holes are directed to the ear drums as similar to the standard prior art insert earphone device, and the additional small hole is directed to the environment. A slide plate is provided inside the insert ear pad, and slides on the inner surface of the insertion ear pad where the additional small hole is opened to the inner chamber. For this reason, the additional small hole is closable with the slide plate, and permits the inner chamber to be open to the outside of the insertion ear pad. A small lug projects from the slide plate into the outside of insertion ear pad so that the user can pinch the small lug with his or her thumb and finger for moving the slide plate.

While the user is hearing the sound by means of the prior art insert earphone device, he or she closes the additional small hole with the slide plate, and the environmental sound hardly penetrates into the external auditory meatus. When the user wishes to hear the environmental sound, he or she pinches the small lug with his or her thumb and finger, and makes the slide plate slide on the inner surface of insertion ear pad in the direction to open the additional small hole. Then, the environmental sound enters the external auditory meatus through the additional small hole, inner chamber and small holes. Thus, the user can hear the environmental sound without taking off the prior art earphone device.

However, a problem is encountered in the prior art earphone device in that the prior art insert earphone device is liable to be dropped off. In detail, the prior art insert earphone device takes the stable attitude in the external auditory meatus merely by virtue of the friction against the skin defining the external auditory meatus. While the user is moving the slide plate with his or her thumb and finger, the user tends unintentionally to push and pull the small lug, and makes the prior art insert earphone device inclined in the external auditory meatus. As a result, the friction against the external ear is partially cancelled, and the reduced friction can not keep the prior art insert earphone device stable in the external auditory meatus. This results in the drop-off of the prior art insert earphone device from the external auditory meatus.

SUMMARY OF THE INVENTION

It is therefore an important object of the present invention to provide an earphone device, which permits users to hear environmental sound without unintentional drop-off from the external ear.

It is another important object of the present invention to provide a sound tube, which forms a part of the earphone device.

It is also an important object of the present invention to provide a sound generating apparatus, which is equipped with the earphone device.

The present inventors contemplated the problem inherent in the prior art earphone device, and noticed that the lug was rigidly connected to the slide plate, which in turn was mechanically coupled to the insertion ear pad. The present inventors got it into their head to use an electric coupling between a change-over means for an external sound propagation path and a controller for the change-over means.

The rigid connection is not required for a signal between the controller and the change-over means. A flexible cable or a radio channel is available for the electric coupling so that a manipulation on the controller does not give rise to any movement of insertion ear pad.

To accomplish the object, the present invention proposes to use an electric coupling with an actuator.

In accordance with one aspect of the present invention, there is provided an earphone device connected to a source of sound signal for sending out sound into at least one external ear of a human being, and the earphone device comprises a signal-to-sound converter converting a sound signal to internal sound, an ear coupler engaged with the aforesaid at least one external ear of the human being and formed with a first sound propagation path open at one end thereof to the aforesaid at least one external ear so that external sound and the internal sound are sent out into the external ear of the human being, and a sound tube connected between the signal-to-sound converter and the ear coupler and formed with a second sound propagation path connected at one end thereof to the other end of the first sound propagation path and at the other end thereof to the signal-to-sound converter so that the internal sound is propagated from the signal-to-sound converter to the first sound propagation path, wherein the sound tube is further formed with an external sound entrance open at one end thereof to environment and at the other end thereof to the second sound propagation path, and wherein the earphone device further comprises an active valve unit supported by the sound tube and responsive to voltage supplied from a source of voltage so as to be deformed for closing the external sound entrance therewith and permitting the environment to be conducted to the second sound propagation path through the external sound entrance and an electric coupling connected to the active valve unit and supplying the voltage to the active valve unit.

In accordance with another aspect of the present invention, there is provided a sound tube connected between a signal-to-sound converter and an ear coupler and formed with a sound propagation path open at one end thereof to the signal-to-sound converter and at the other end thereof to the ear coupler so that sound is sent out through the ear coupler to an external ear of a human being, the sound tube is further formed with an external sound entrance open at one end thereof to environment and at the other end thereof to the sound propagation path, and the sound tube supports an active valve unit responsive to voltage supplied from a source of voltage through an electric coupling so as to be deformed for closing the external sound entrance therewith and permitting the environment to be conducted to the sound propagation path through the external sound entrance.

In accordance with yet another aspect of the present invention, there is provided a sound generating apparatus for supplying sound to a human being comprises a source of sound signal for producing a sound signal, a source of voltage for generating voltage and an earphone device connected to the source of sound signal and the source of voltage for sending out sound into at least one external ear of the human being, and the earphone device includes a signal-to-sound converter converting the sound signal to internal sound, an ear coupler engaged with the aforesaid at least one external ear of the human being and formed with a first sound propagation path open at one end thereof to the aforesaid at least one external ear so that external sound and the internal sound are sent out into the external ear of the human being and a sound tube connected between the signal-to-sound converter and the ear coupler and formed with a second sound propagation path connected at one end thereof to the other end of the first sound propagation path and at the other end thereof to the signal-to-sound converter so that the internal sound is propagated from the signal-to-sound converter to the first sound propagation path, wherein the sound tube is further formed with an external sound entrance open at one end thereof to environment and at the other end thereof to the second sound propagation path, and wherein the earphone device further comprises an active valve unit supported by the sound tube and responsive to voltage so as to be deformed for closing the external sound entrance therewith and permitting the environment to be conducted to the second sound propagation path through the external sound entrance and an electric coupling connected between the source of voltage and the active valve unit for supplying the voltage to the active valve unit.

BRIEF DESCRIPTION OF THE DRAWINGS

The features and advantages of the earphone device, sound tube and sound generating apparatus will be more clearly understood from the following description taken in conjunction with the accompanying drawings, in which.

DESCRIPTION OF THE PREFERRED EMBODIMENTS

Figure 1:
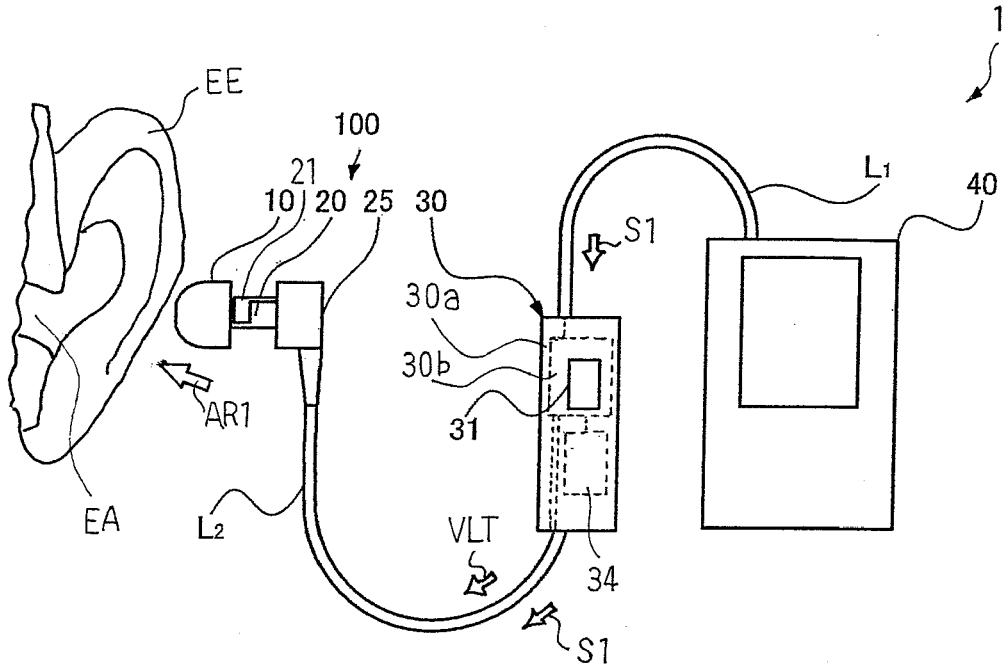
FIG. 1 is a schematic front view showing the external appearance of a portable music player according to the present invention.

A sound generating apparatus embodying the present invention is provided for supplying sound to a human being. The sound generating apparatus largely comprises a source of sound signal, a source of voltage and an earphone device. The source of sound signal is connected to the earphone device, and the source of voltage is also connected to the earphone device.

The source of sound signal produces a sound signal, and the source of voltage generates voltage. The sound signal and voltage are supplied to the earphone device.

The earphone device sends out sound, internal sound and/or external sound into an external ear or external ears of the human being. The earphone device includes a signal-to-sound converter, an ear coupler, a sound tube, an active valve unit and an electric coupling. The signal-to-sound converter is connected through the sound tube to the ear coupler, and the ear coupler is engaged with the external ear or external ears so as to keep the signal-to-sound converter in the vicinity of the external ear or external ears. The ear coupler is formed with a first sound propagation path, and the first sound propagation path is open at one end thereof to the external ear or external ears. The external sound and the internal sound are propagated through the first sound propagation path, and are sent out into the external ear or external ears of the human being.

The active valve is supported by the sound tube. The active valve unit may be provided inside or on the sound tube. The source of voltage is connected to the active valve unit through the electric coupling so that the voltage is applied through the electric coupling to the active valve unit.

The signal-to-sound converter is supplied with the sound signal, and converts the sound signal to the internal sound. The sound tube is formed with a second sound propagation path, and the second sound propagation path is connected at one end thereof to the other end of the first sound propagation path and at the other end thereof to the signal-to-sound converter. For this reason, the internal sound is propagated from the signal-to-sound converter through the second sound propagation path into the first sound propagation path, and is sent out into the external ear or external ears.

The sound tube is further formed with an external sound entrance, and is open at one end thereof to environment and at the other end thereof to the second sound propagation path. The active valve unit is provided in the vicinity of the external sound entrance, and the external sound entrance is closed with is conducted between the environment and the second sound propagation path by means of the active valve unit.

The active valve unit is responsive to the voltage so as to be deformed between two positions. While the active valve unit is staying one of the two positions, the external sound entrance is closed with the active valve unit. When the active valve unit is changed to the other of the two positions, the external sound entrance is opened, and the active valve unit permits the environment to be conducted to the second sound propagation path through the external sound entrance.

The voltage is applied to the active valve unit through the electric coupling. The electric coupling is flexible so that the signal-to-sound converter, sound tube and ear coupling are not moved due to the change of voltage.

First Embodiment

Referring first to FIG. 1 of the drawings, an insert earphone device 100 of the present invention is connected to a portable sound signal generator 40 such as, for example, a music reproducer, a voice recorder/reproducer, a hearing aid or a portable radio through a cable L1. The portable sound signal generator 40, cable L1 and insert earphone device 100 as a whole constitute a sound generating apparatus 1.

The portable sound signal generator 40 produces an audio signal S1, which is representative of music sound or human voice, and the audio signal S1 is propagated through the cable L1 to the insert earphone device 100. The music reproducer, voice recorder/reproducer, hearing aid, portable radio and etc. are well known to persons skilled in the art, and, for this reason, no further description is incorporated for the sake of simplicity.

The insert earphone device 100 largely comprises an inserting body 10, a sound tube 20, an active valve unit 21, an electro-acoustic device 25, a controller 30 and a cable L2. The electro-acoustic device 25 is connected to the portable sound signal generator 40 through the cables L1 and L2 and signal propagation path inside the controller 30, and converts the audio signal S1 to acoustic waves or sound.

The sound tube 20 projects from the electro-acoustic device 25, and the inserting body 10 is fitted to the leading end of the sound tube 20. The acoustic waves or sound is propagated from the electro-acoustic device 25 through the sound tube 20 to the inserting body 10, and is radiated from the inserting body 10 to the outside thereof.

The active valve unit 21 is provided on an outer surface of the sound tube 20, and is electrically connected to the controller 30 through the cable L2. Voltage VLT is supplied from the controller 30 through the cable L2 to the active valve unit 21, and gives rise to deformation of the active valve unit 21 as will be hereinlater described in detail. In this instance, the cable L2 is used for the electric coupling between the controller 30 and the active valve unit 21.

Thus, the active valve unit 21 is controlled with the controller 30, and makes the insert earphone device 100 between sound insulating state and sound propagation state. While the insert earphone device 100 is staying in the sound propagation state, the active valve unit 21 is deformed, and permits environmental sound, which is generated outside of the insert earphone device 100, to penetrate into the inserting body 10. On the other hand, when the insert earphone device 100 is changed from the sound propagation state to the sound insulating state, the active valve unit 21 is restored to original configuration, and blocks the inserting body 10 from the environment.

In the following description, term "external sound" means the sound produced in the environment, and term "internal sound" means the sound converted through the electro-acoustic device 25.

When a user wishes to hear the internal sound, the user inserts the inserting body 10 into his or her external auditory meatus EA, and the inserting body 10 keeps the electro-acoustic device 20 on the external ear EE of the user. The user confirms the present status of insert earphone device 100 on the controller 30. If the sound propagation state is established in the insert earphone device 100, he or she manipulates the controller 30 so as to change the insert earphone device to the sound insulating state. While the user is manipulating the controller 30, he or she exerts force on the controller 30 so that the controller 30 is shaken due to the force. However, the cable L2 takes up the shakes, and the force is not transmitted to the inserting body 10. For this reason, the inserting body 10, sound tube 20 and electro-acoustic device 25 are stable in an external auditory meatus EA of user. Thereafter, the user turns on the portable sound signal generator 40. Then, the portable sound signal generator 40 starts to supply the audio signal S1 through the cables L1 and L2 to the electro-acoustic device 25. The audio signal S1 is converted to the internal sound, and the internal sound is radiated to the external auditory meatus EA through the sound tube 20 and inserting body 10.

If, on the other hand, the user wishes to hear the external sound, he or she manipulates the controller 30, and the voltage VLT is applied through the cable L2 to the active valve unit 21. The shakes of controller 30 do not have any influence on the inserting body 10 by virtue of the electric coupling. The active valve unit 21 is deformed in the presence of voltage VLT, and makes the environment conducted to the inserting body 10 through the sound tube 20. The external sound penetrates into the sound tube 20 and inserting body 10, and enters the external auditory meatus EA of user. Thus, the user can hear the external sound without pulling out the inserting body 10 from the external auditory meatus EA.

Figure 2A:
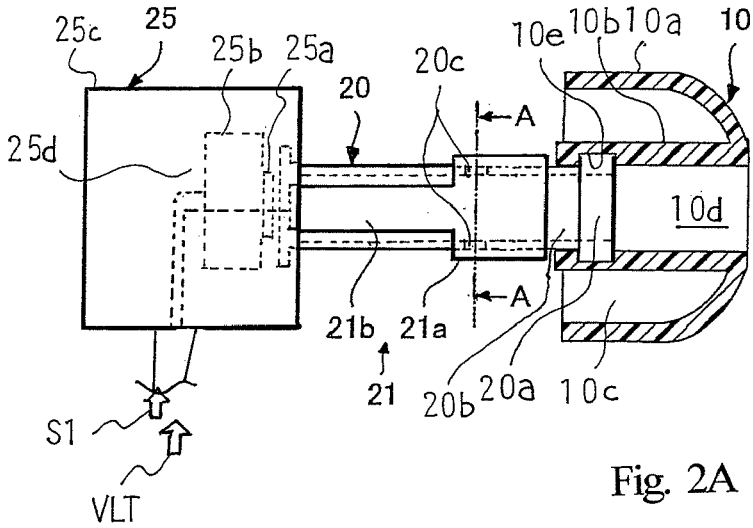
FIG. 2A is a partially cross sectional front view showing an insert earphone device of the present invention.

Turning to FIG. 2A of the drawings, the inserting body 10 has an external appearance like a cap of a mushroom, and is made of synthetic resin such as, for example, silicone resin.

The inserting body 10 has an outer bell-shaped wall 10*a* and an inner cylindrical wall 10*b*, and one end of outer bell-shaped wall 10*a* is merged with one end of inner cylindrical wall 10*b*. However, the other end of outer bell-shaped wall 10*a* is spaced from the other end of cylindrical wall 10*b*. As a result, a pocket 10*c* takes place between the inner surface of outer bell-shaped wall 10*a* and the outer surface of inner cylindrical wall 10*b*. The end portions, which are merged with each other, is hereinafter referred to as a "sound outlet end" of inserting body 10, and the opposite ends, which are spaced from each other, are referred to as a "sound inlet end" of inserting body 10.

A sound propagation hole 10*d* is defined by the inner cylindrical wall 10*b*. The hole is open at both ends thereof to the outside, and serves as a sound propagation path. The internal sound and external sound enter the sound propagation hole 10*d* at one end thereof, and are propagated through the sound propagation hole 10*d* to the other end. While the inserting body 10 is being kept in the external auditory meatus EA, the other end of sound propagation hole 10*d* is open to the external auditory meatus EA so that the internal sound and external sound are radiated or sent out from the inserting body 10 to the external auditory meatus EA.

When a user inserts the inserting body 10 into his or her external auditory meatus EA, he or she directs the merged portion of inserting body 10 to the external auditory meatus EA, and pushes the inserting body 10 into the external auditory meatus EA. While the inserting body 10 is advancing, the outer bell-shaped wall 10*a* is deformed due to the reaction against the movement of inserting body 10, and the pocket 10*c* allows the outer bell-shaped wall 10*a* to be resiliently deformed. When the user stops the inserting body 10, the resilient force is exerted onto the skin defining the external auditory meatus EA so that the friction between the skin and the outer surface of outer bell-shaped wall 10*a* is increased by virtue of the resilient force. Thus, the resiliently deformed outer bell-shaped wall 10*a* prevents the inserting body 10 from dropping off from the external auditory meatus EA.

A ring groove 10*e* is formed in the inner cylindrical wall 10*b*, and is open to the sound propagation hole 10*d*. The sound tube 20 has a generally cylindrical configuration, and is formed of resiliently deformable synthetic resin. The outer diameter of sound tube 20 is slightly shorter than the inner diameter of sound propagation hole 10*d*. For this reason, the sound tube 20 is inserted into the sound propagation hole 10*d*. The sound tube 20 is formed with a flange 20*a*, and the flange 20*a* outwardly projects from the outer surface of remaining tube portion of sound tube 20 by a predetermined distance. The predetermined distance is approximately equal to the depth of ring groove 10*e*. When a user wishes to insert the sound tube 20 into the sound propagation hole 10*d*, he or she aligns the centerline of sound tube 20 with the centerline of sound propagation hole 10*d*, and pushes the sound tube 20 into the sound propagation hole 10*d*. The flange 20*a* proceeds toward the ring groove 10*e*, and is snugly received in the ring groove 10*e*. As a result, the sound tube 20 is connected to the inserting body 10. If the user strongly pulls the inserting body 10 and sound tube 20 in the opposite directions, the flange 20*a* is disconnected from the ring groove 10*e*, and the inserting body 10 is detached from the sound tube 20.

The electro-acoustic device 25 includes a diaphragm 25*a*, an exciter 25*b* and a housing 25*c*. The housing 25*c* is formed with an inner chamber 25*d*, and the diaphragm 25*a* and exciter 25*b* are accommodated in the housing 25*c*. While the audio signal S1 is being supplied to the exciter 25*b*, the exciter 25*b* gives rise to vibrations of the diaphragm 25*a*, and the vibrating diaphragm 25*a* produces the internal sound.

The exciter 25*b* is, by way of example, implemented by a coil unit, and the conduction path of cable L2 for the audio signal S1 is connected to the coil unit serving as the exciter 25*b*. While the audio signal S1 is flowing through the exciter 25*b*, magnetic field is created around the exciter 25*b*, and the magnetic force is exerted on the diaphragm 25*a* in the magnetic field. The audio signal S1 causes the magnetic force to be varied so that the diaphragm 25*a* vibrates depending upon the magnitude of magnetic force. Thus, the audio signal S1 is converted to acoustic waves, i.e., the internal sound through the electro-acoustic device 25. The acoustic waves or internal sound is radiated from the electro-acoustic device 25 into the sound propagation hole 20*b*, and enters the inserting body 10.

The sound tube 20 is formed with a sound propagation hole 20*b* and through-holes or external sound entrances 20*c*. The external sound entrances 20C are open at the inner ends thereof to the sound propagation hole 20*b* and at the outer ends thereof to the environment. The sound tube 20 is connected to the electro-acoustic device 25 in a similar manner to the boundary to the inserting body 10. As described hereinbefore, the flange 20*a* and ring groove 10*e* keep the sound tube 20 and inserting body 10 engaged with one another so that the sound propagation hole 20*b* is conducted to the sound propagation hole 10*d* at the flange 20*a*. The other end of sound propagation hole 20*b* is open to the inner chamber 25*d*, and the diaphragm 25*a* is opposed to the other end of sound propagation hole 20*b*. For this reason, while the diaphragm 25*a* is vibrating, the internal sound enters into the sound propagation hole 20*b*, and the sound propagation hole 20*b* makes the internal sound enter the sound propagation hole 10*d*.

Figure 2B:
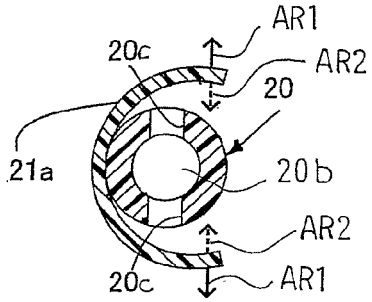
FIG. 2B is a cross sectional view taken along line A-A of FIG. 2A and showing an active valve unit on a sound tube in sound insulating state.
Figure 2C:
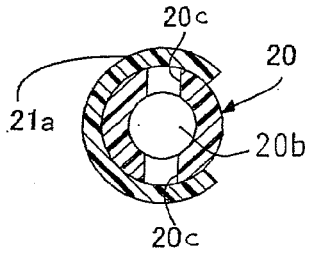
FIG. 2C is a cross sectional view also taken along line A-A of FIG. 2A and showing the active value on the sound tube in sound propagation state.

A conductive polymer actuator is used as the active valve unit 21, and the active valve unit 21 is provided on the outer surface of sound tube 20. The active valve unit 21 has a valve body 12*a* and a connecting portion 21*b*. The connecting portion 21*b* is like a narrow strip, and extends on the outer surface of sound tube 20 in parallel to the centerline of sound tube 20. The connecting portion 21*b* penetrates into the housing 25*c*, and is connected at the other end to the valve body 12*a*. The boss portion 21*b* is secured to the sound tube 20, and the voltage VLT is applied to the one end of the boss portion 21*b*. The valve body 21*a* has a cross section like a C-letter, and is wound on the outer surface of sound tube 20 as shown in FIGS. 2B and 2C. The valve body 21*a* is spaced from and brought into contact with the outer surface where the external sound entrances 20*c* are open so that the external sound entrances 20*c* are opened and closed with the valve body 21*a*.

Figure 3A:
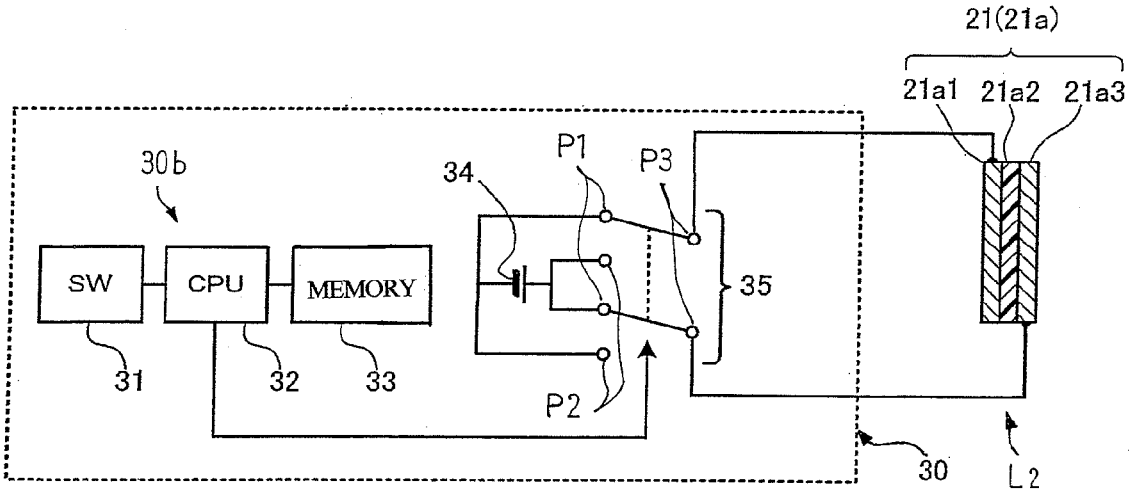
FIG. 3A is a circuit diagram showing the circuit configuration of an electronic system incorporated in a controller of the insert earphone device.

The active valve unit 21 is formed from a sheet of electroactive polymer 21*a*2 and conductive plates 21*a*1 and 21*a*3 as will be seen in FIG. 3A. The conductive plates 12*f* and 12*h* serve as electrodes, and are formed of conductive metal such as, for example, gold, platinum, copper or aluminum, carbon or carbon-contained resin.

Conductive polymers and fluorine-contained ion exchange resins are available for the sheet of electroactive polymer 21*a*2. The electroactive polymer is shrunk and expands on the condition of the applied voltage VLT. The shrinkage and expansion are dependent on the polarity of applied voltage VLT. The electroactive polymers have been found in various applications such as, for example, actuators and artificial muscles.

While the applied potential is being in a predetermined polarity, the valve body 21*a* is held in contact with the outer surface of sound tube 20, and the external sound entrances 20*c* are closed with the valve body 21*a* as shown in FIG. 2C. This is because of the fact that the annular cross section of sound tube 20 has a radius of curvature at the outer surface thereof approximately equal to that of the valve body at the inner surface thereof. The sound insulating state is established in the insert earphone device 100, and the sound propagation hole 20*b* is acoustically isolated from the environment. For this reason, only the internal sound is propagated to the sound propagation hole 10*d* of inserting body 10.

On the other hand, when the applied voltage VLT is changed to the opposite polarity, the valve body 21*a* is expanded as indicated by arrows AR1, and the radius of curvature of the C-letter shaped cross section is increased. The valve body 21*a* is spaced from the outer surface of sound tube 20 as shown in FIG. 2B. As a result, the insert earphone device is changed to the sound propagation state. The environment is conducted to the sound propagation hole 20*b* through the external sound entrances 20*c*, and the external sound penetrates through the external sound entrances 20*c* to the sound propagation holes 20*b* and 10*d*.

When the applied voltage VLT is restored to the predetermined polarity, the valve body 21*a* is shrunk as indicated by arrows AR2, and the valve body 21*a* is brought into contact with the outer surface of sound tube 20. The external sound entrances 20*c* are closed with the valve body 21*a*, again, and the insert earphone device 100 is changed to the sound insulating state.

Turning back to FIG. 1 of the drawings, the controller 30 includes a battery case 30*a*, a circuit board 30*b*, button switch 31 and a battery cell unit 34. The circuit configuration on the circuit board will be hereinafter described with reference to FIG. 3A. The button switch 31 is exposed to the outside of the battery case 30*a* so that the user changes the polarity of applied voltage VLT by pushing the button switch 31. As described hereinbefore, the controller 30 is connected to the active valve unit 21 and electro-acoustic device 25 through the cable L2. The cable L2 is so flexible that the movements of controller 30 are absorbed by the cable L2. As a result, the movements of controller 30 are not transmitted to the inserting body 10, and the inserting body 10 is not unintentionally dropped off from the external ear EE of user during the manipulations on the controller 30.

Turning to FIG. 3A of the drawings, an electronic system on the circuit board 30*b* includes a central processing unit 32, a memory 33 and a DPDT (Double-Port Double-throw) switch 35. The central processing unit 32 and memory 33 may be implemented by a single-chip microcomputer device. The button switch 31 is connected to an input data pin of the central processing unit 32, and an output signal pin is connected to a control terminal of the DPDT switch 35. The central processing unit 32 is connected to a shared bus system to the memory 33. A computer program is stored in the memory 33, and data registers are further defined in the memory 33. The DPDT switch 35 has three pairs of nodes P1, P2 and P3. One of the notes P1 and one of the nodes P2 are connected to the positive terminal of the battery cell unit 34, and the others of the node pairs P2 and P3 are connected to the negative terminal of the battery cell unit 34.

The DPDT switch 35 is responsive to a switch control signal at the control terminal so as selectively to connect the pair of nodes P1 or P2 to the pair of nodes P3. While the pair of nodes P1 is being connected to the pair of nodes P3 as shown in FIG. 3A, the battery unit 30 applies the voltage VLT in the opposite polarity to the active valve unit 21, and the applied voltage VLT remains the active diaphragm 12 shrunk as shown in FIG. 2C. The external sound entrances 20*c* are kept closed with the valve body 21*a*, and the sound propagation hole 20*b* is acoustically isolated from the environment.

On the other hand, when the user wishes to hear the external sound, he or she makes the pair of nodes P2 connected to the pair of nodes P3. Then, the active valve unit 21 is applied with the potential in the predetermined polarity, and expands as shown in FIG. 2B. The valve body 21*a* is spaced from the outer surface of sound tube 20, and the external sound entrances 20*c* are open to the environment. Then, the external sound is conducted through the sound propagation holes 20*b* and 10*d* to the external auditory meatus EA of user.

Figure 3B:
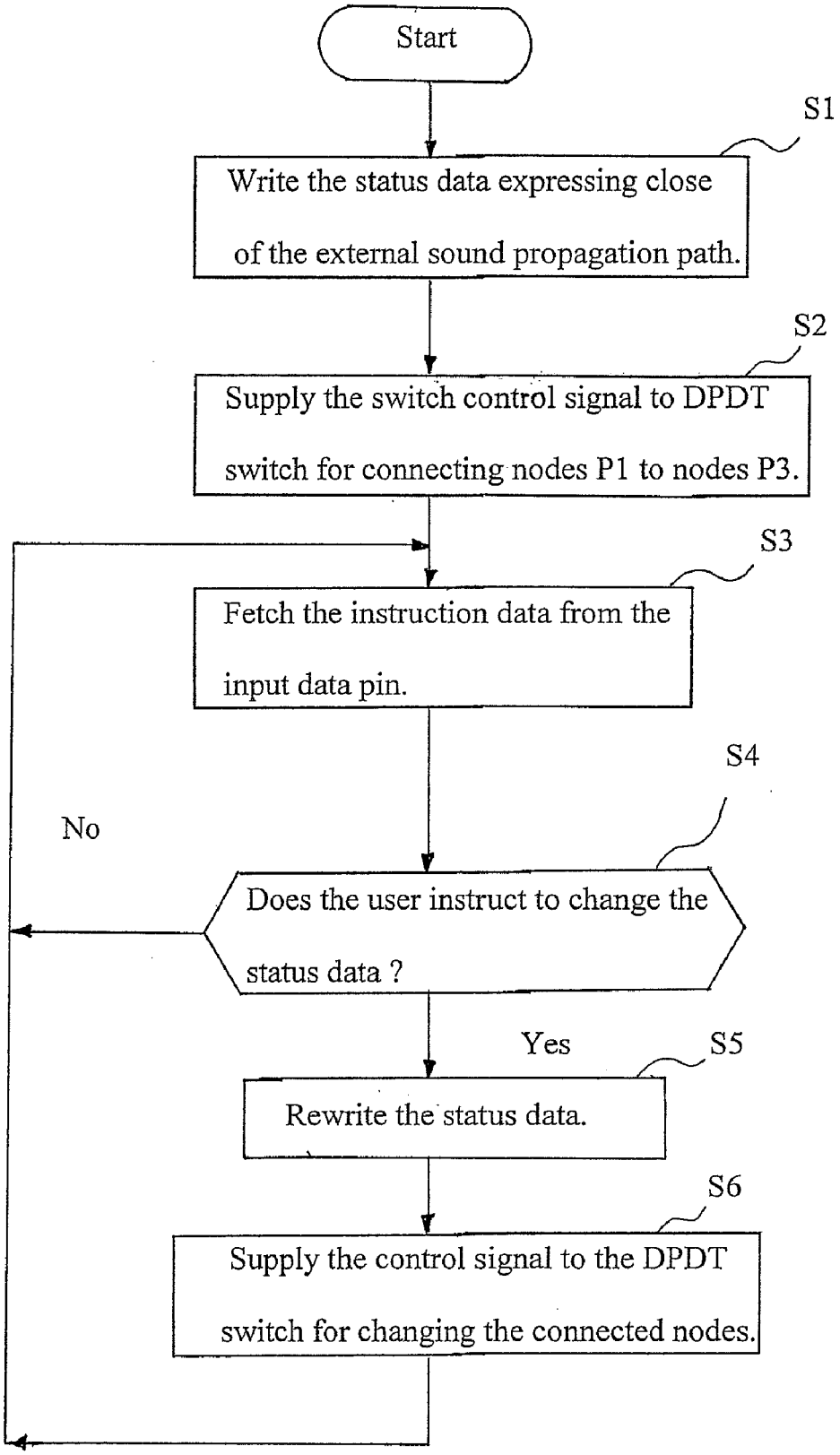
FIG. 3B is a flowchart showing the job sequence of a computer program running on the electronic system.

Turning to FIG. 3B of the drawings, a job sequence of the computer program is illustrated. When the electronic system is powered, the computer program starts to run on the central processing unit 32. The central processing unit 32 firstly carries out the system initialization, and, thereafter, reiterates a job loop until the electric power is removed from the central processing unit 32.

In detail, the central processing unit 32 writes a piece of status data expressing default status of the insert earphone device 100 as by step S1. In this instance, the default status is the sound insulating state of the insert earphone device 100. Thereafter, the central processing unit 32 supplies the switch control signal representative of the connection between the pair of nodes P1 and the pair of nodes P3 to the DPDT switch 35. The potential in the opposite polarity is supplied from the controller 30 through the cable L2 to the active valve unit 21, and makes the active valve unit 21 shrunk. As a result, the external sound entrances 20*c* are closed with the valve body 21*a*of active valve unit 21, and the external auditory meatus EA of user is blocked from the environment. Upon completion of the job at step S2, the central processing unit 32 enters the job loop, and periodically monitors the input data pin connected to the button switch 31. Although the central processing unit 32 repeats the loop at time intervals slightly longer than the pulse width of a one-shot pulse signal supplied from the button switch 31, the jobs for measuring the time intervals are deleted from the job sequence for the sake of simplicity.

First, the central processing unit 32 fetches a piece of instruction data expressing user's instruction from the input data pin as by step S3. The user gives his or her instruction to the central processing unit 32 through the button switch 31. When the user once pushes the button switch 31, the one-shot pulse signal is generated, and is supplied from the button switch 31 to the input data pin of central processing unit 32. If the user pushes the button switch 31, again, the one-shot pulse signal is also supplied to the input data pin. Thus, the piece of instruction data, which expresses the change of piece of status data, is carried by the one-shot pulse signal. On the other hand, while the user is not wishing to change the state of insert earphone device 100, he or she does not push the button switch 31, and any one-shot pulse signal is not supplied to the input data pin. In other words, the piece of instruction data, which expresses the unchanged state of insert earphone device 100, is expressed by the absence of one-shot pulse signal.

The central processing unit 32 checks the piece of instruction data to see whether or not the user wishes to change the state of external sound propagation path 13 as by step S4. If the user keeps the state of insert earphone device 100 unchanged, the user does not push the button switch 31, and the piece of instruction data expresses the absence of one-shot pulse signal. Then, the answer at step S4 is given negative "No", and the central processing unit 32 returns to the step S3. In this situation, the user can listen to the internal sound without any disturbance of external sound.

If, on the other hand, the user wishes to change the state of insert earphone device 100, he or she pushes the button switch 3 1, and the piece of instruction data expresses the change of state. Then, the answer at step S4 is given affirmative "Yes".

The piece of status data stored in the data register is assumed to express the sound isolating state of insert earphone device 100. The central processing unit 32 rewrites the piece of status data as by step S5 so that the piece of status data expresses the sound propagation state of insert earphone device 100.

Subsequently, the central processing unit 32 supplies the switch control signal representative of the connection between the nodes P2 and the nodes P3 to the DPDT switch 35 as by step S6. With the switch control signal, the pair of nodes P1 is isolated from the pair of nodes P3, and the pair of nodes P2 is connected to the pair of nodes P3. The potential in the predetermined polarity is applied to the active valve unit 21. The electroactive polymer expands, and the valve body 21 a is increased in the radius of curvature as indicated by arrows AR1. As a result, the valve body 21*a* is spaced from the outer surface of the sound tube 20, and the environment is conducted to the external auditory meatus EA of user through the sound propagation holes 20*b* and 10*d*. Then, the external sound enters the external auditory meatus EA, and the user can hear the external sound without taking off the inserting body 10. If the user does not turn off the source of sound signal 40, he or she hears both of the internal sound and external sound.

As will be understood from the foregoing description, the active valve unit 21 is moved with the applied voltage VLT through the electric coupling, i.e., the cable L2, and any rigid coupling is not required for the propagation of electric power. This results in that the inserting body 10 is free from the movements of the controller 30. For this reason, the inserting body 10 is not unintentionally dropped off from the external ear EE.

Moreover, the active valve unit 21 is provided on the sound tube so that the inserting body 10 is free from any deformation at the change of state. This feature is desirable, because the active valve unit 21 does not reduce the friction between the inserting body 10 and the skin defining the external auditory meatus EA.

Second Embodiment

Figure 4:
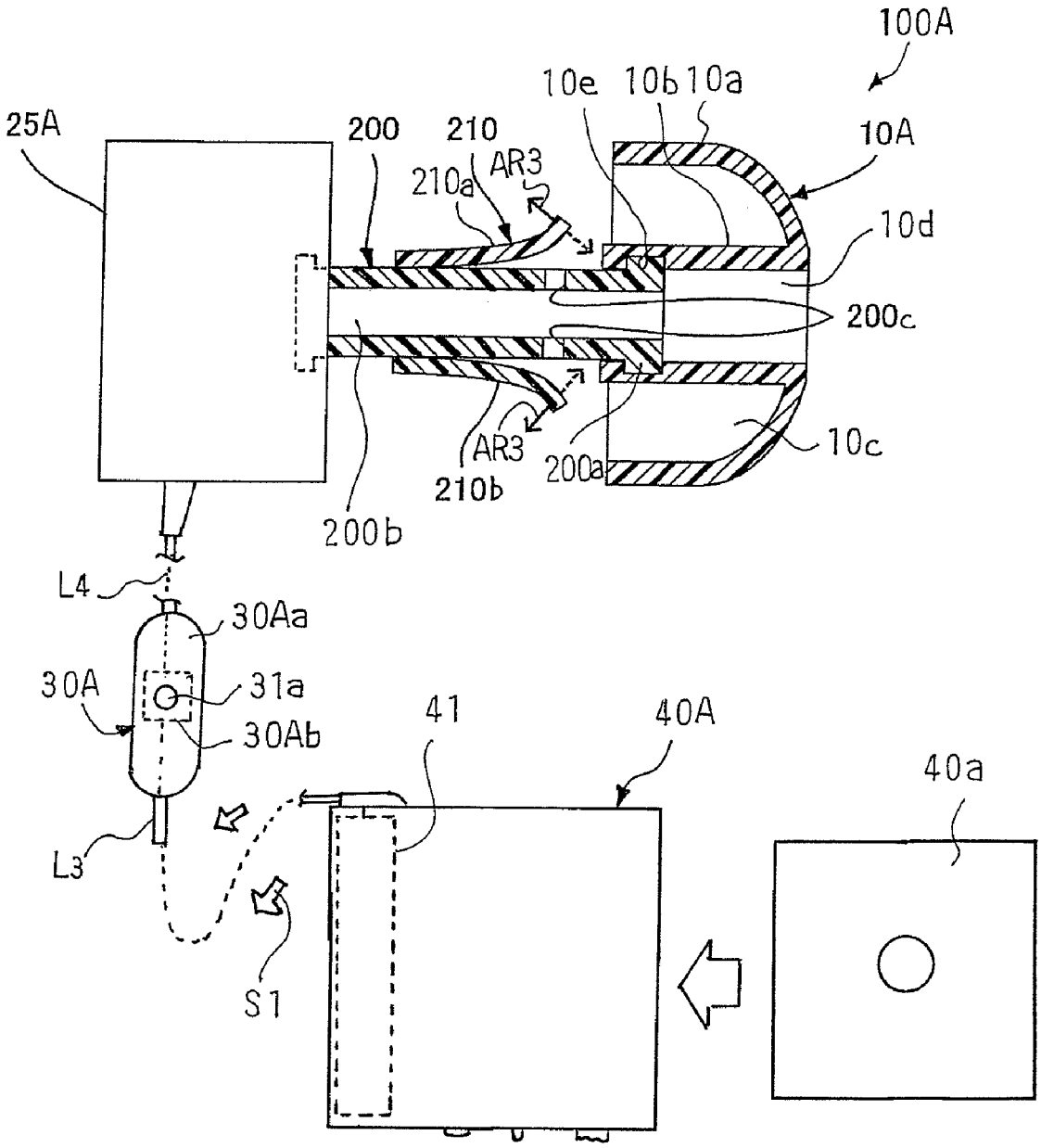
FIG. 4 is a schematic cross sectional view of another insert earphone device of the present invention.

Turning to FIG. 4 of the drawings, another insert earphone device 100A is connected to an MD (Mini Disc) player 40A through a cable L3. The insert earphone device 100A, cable L3 and MD player 40A as a whole constitute a sound generating apparatus of the present invention. Plural music files are stored in a mini-disc 40*a*, and the mini-disc 40*a* is loaded into the MD player 40A for playback of music tunes. An audio signal S1 is produced from the pieces of audio data stored in the music files, and is supplied from the MD player 40A through the cable L3 to the insert earphone device 100A.

The insert earphone device 100A also includes an inserting body 10A, a sound tube 200, an active valve unit 210, an electro-acoustic device 25A, a cable L4 and a controller 30A. A difference from the insert earphone device 100 is that voltage VLT is applied from a battery unit 41 of the MD player 40A to the active valve unit 210 so that the voltage VLT is supplied from the battery unit 41 of MD player 40A through the controller 30A and cables L3 and L4 to the active valve unit 210. Another difference is a configuration of active valve unit 210 and a configuration of sound tube 200. However, the inserting body 10A and electro-acoustic device 25A are similar in structure to the inserting body 10 and electro-acoustic device 25. For this reason, portions of the inserting body 10A are labeled with the references designating the corresponding portions of inserting body 10A, and description is hereinafter focused on the controller 30A, sound tube 200 and active valve unit 210.

The configuration of sound tube 200 has a square column configuration, and two pairs of flat surfaces define the external appearance of the sound tube 200. The sound tube 200 is formed with a flange 200*a*, and the flange 200*a* is received in the groove 10*e* of inserting body 10A so that the sound tube 200 is connected at the one end thereof to the inserting body 10A and at the other end thereof to the electro-acoustic device 25A.

The sound tube 200 is further formed with a sound propagation hole 200*b*, and is shaped in a square column. Thus, the sound tube 200 has a square frame-like cross section. The sound propagation hole 200*b* is open at one end thereof to the sound propagation hole 10*d* and at the other end thereof to the inner chamber of electro-acoustic device 25A. External sound entrances 200*c* are formed in the sound tube 200, and are open at the outer ends thereof to the flat surfaces of one of the two pairs and at the inner ends thereof to the sound propagation hole 200*b*.

The active valve unit 210 has a pair of leaf valves 210*a* and 210*b*. Each of leaf valves 210*a*/210*b* has two conductive layers and an electroactive polymer layer, and the electroactive polymer layer is sandwiched between the conductive layers. The electroactive polymer layer and conductive layers are made of polymer and conductive material, which are same as those of the active valve unit 21.

The leaf valves 210*a* and 210*b* are provided on the flat surfaces where the external sound entrances 200*c* are opened. The leaf valves 210*a* and 210*b* are respectively secured to the flat surfaces, and extend over the external sound entrances 200*c*. A conductive line of cable L4 is assigned to the voltage VLT, and is connected to the leaf valves 210*a* and 210*b*.

The controller 30A has a case 30Aa, a circuit board 30Ab and a button switch 31*a*. The circuit board 30Ab is housed in the case 30Aa, and the button switch 31*a* is exposed to the outside of case 30Aa. A DPDT switch and a change-over circuit are provided on the circuit board. When a user once pushes the button switch 31*a*, the change-over circuit makes the polarity of voltage VLT on the conductive line of cable L4 changed by means of the DPDT switch. Though not shown in FIG. 4, the controller 30A further has an on-off switch, a volume lever, other switches and an electronic system for controlling the playback of music tunes.

A user is assumed to turn on the MD player 40A. The controller 30A establishes the sound insulating state as the default state in the insert earphone device by closing the external sound entrances 200*c* with the leave valves 210*a* and 210*b*. The applied voltage VLT in the opposite polarity makes the leaf valves 210*a* and 210*b* tightly held in contact with the flat surfaces of sound tube 200, because the leave valves 210*a* and 210*b* also have flat surfaces.

While the audio signal S1 is being supplied from the MD player 40A through the controller 30A to the insert earphone device 100A. The audio signal S1 is converted to the internal sound through the electro-acoustic device 25A. The internal sound is propagated through the sound propagation holes 200*b* and 10*d* to the external auditory meatus EA, and gives rise to vibrations of the ear drum of user. However, the leaf valves 210*a* and 210*b* do not permit the external sound to penetrate into the sound propagation hole 200*b*. For this reason, the external sound is not mixed with the internal sound.

The user is assumed to notify a person talk to him or her. The user pushes the button switch 31*a*. Even if the user gives rise to shakes of the controller 30A, the shakes are not transmitted to the inserting body 10A by virtue of the flexibility of cable L4, and the inserting body 10A is not unintentionally dropped off from the external ear EE. When the user pushes the button switch 31*a*, the applied voltage VLT is changed from the opposite polarity to the predetermined polarity. The leaf valves 210*a* and 210*b* are deformed, and are spaced from the flat surfaces of sound tube 200 as indicated by arrows AR3. The external sound entrances 200*c* are opened to the environment, and the voice enters the sound propagation hole 200*b* through the external sound propagation hole 200*b*. The internal sound and external sound are propagated through the sound propagation holes 200*b* and 10*d* to the external auditory meatus EA, and give rise to vibrations of the ear drum. Thus, the user can hear both of the internal sound and external sound without taking off the inserting body 10A.

As will be understood from the foregoing description, the flexible cable L4 or electric coupling prevents the inserting body 10A from the shakes of controller 30A. For this reason, the user selectively hears the internal sound and both of the internal sound and external sound without taking off the inserting body 10A.

Moreover, the flat surfaces of sound tube 200 make the leaf valves 210*a* and 210*b* tightly held in contact therewith under the application of voltage VLT in the opposite polarity so that the external sound is hardly leaked into the sound tube 200.

Modifications

Although particular embodiments of the present invention have been shown and described, it will be apparent to those skilled in the art that various changes and modifications may be made without departing from the spirit and scope of the present invention.

The configurations of active valve units 21 and 210, the configurations of sound tubes 20 and 200 and the configuration of inserting body 10 do not set any limit to the technical scope of the present invention.

Figure 5A:
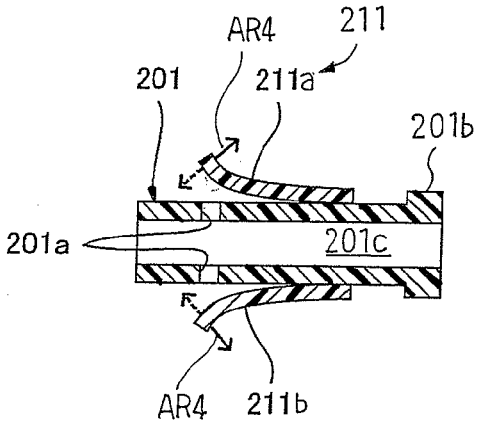
FIG. 5A is a cross sectional view showing an active valve unit on a sound tube of yet another insert earphone device of the present invention.
Figure 5B:
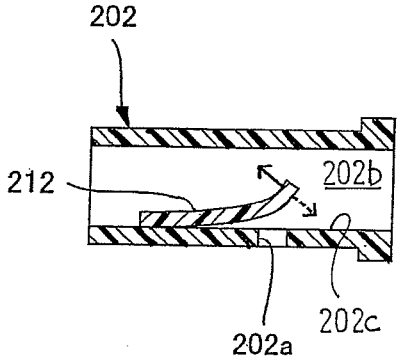
FIG. 5B is a cross sectional view showing an active valve unit on a sound tube of still another insert earphone device of the present invention.

For example, external sound entrances 201*a* may be formed in a sound tube 201 closer to the electro-acoustic device rather than the inserting body as shown in FIG. 5A. Reference sign 201*b* is indicative of a flange to be received in the groove of inserting body. The inserting body is provided on the right side of sound tube 201, and the electro-acoustic device is provided on the left side of sound tube 201.

An active valve unit 211 has leaf valves 211*a* and 211*b*, and is provided on the flat outer surfaces of sound tube 201. The leaf valves 211*a* and 211*b* are respectively assigned to the external sound entrances 201*a*. The leaf valves 211*a* and 211*b* are similar in multi-layered structure and material to the leaf valves 210*a* and 210*b*. Parts of the leaf valves 211*a* and 211*b* which are closer to the flange 201*b* are secured to the flat outer surfaces, and the remaining parts extend on the flat outer surfaces over the external sound entrances 201*a*. A sound propagation hole of the sound tube 201 is labeled with reference "201*c*".

While the voltage VLT in the opposite polarity is being applied to the leaf valves 211*a* and 211*b*, the leaf valves 211*a* and 211*b* are tightly held in contact with the flat outer surfaces of sound tube 201, and the external sound entrances 201*a* are closed with the leaf valves 211*a* and 211*b*. On the other hand, when the user changes the applied voltage VLT from the opposite polarity to the predetermined polarity, the leaf valves 211*a* and 211*b* are deformed as indicated by arrows AR4, and the remaining portions of leaf valves 211*a* and 211*b* are spaced from the flat outer surfaces of sound tube 201. Then, the external sound entrances 201*a* are opened. Thus, the leaf valves 211*a* and 211*b* make it possible to permit the external sound to reach the ear drum of user.

The active valve units 10, 10A and 211, which are provided on the outer surface of sound tubes 20 and 200, do not set any limit to the technical scope of the present invention. An active valve unit 212 of the present invention is provided inside a sound tube 202. The sound tube 202 is formed with an external sound entrance 202*a* and a sound propagation hole 202*b*. The sound tube 202 may be larger in diameter than that of the sound tube 201. The sound propagation hole 202*b* extends in parallel to a centerline of the sound tube 202, and is defined by flat inner surfaces 202*c*. The external sound entrance 202*a* is open at one end thereof to the flat inner surface 202*a* and at the other end thereof to the outer surface of sound tube 202.

The active valve unit 212 is implemented by a leaf valve, which is similar in structure and material to the leaf valves 211*a* and 211*b*. The leaf valve 212 is provided on the flat inner surface 202*c*, and is secured at one end portion thereof to the flat inner surface 202*c*. The remaining portion of leaf valve 212 extends over the external sound entrance 202*a*, and is spaced from and brought into contact with the flat inner surface 202*c* depending upon the polarity of applied voltage.

The active valve unit 212 provided inside the sound tube 202 is preferable to the active valves 21, 210 and 211, which are provided outside of sound tubes 20, 200 and 201, from the viewpoint of durability. Even if something gives a shock to the sound tube 202, the active valve 212 is less damaged. For this reason, the active valve unit 212 is durable.

Moreover, the active valve unit 212 prevents the inner sound from entry into the inserting body during the external sound entrance 202*a* is opened. As a result, the inner sound is reduced in volume. This feature is desirable, because the user can clearly hear the external sound.

The cylindrical sound tube 20 and square column sound tube 200 do not set any limit to the technical scope of the present invention. In other words, the cross section of sound tube is not indispensable feature of the present invention.

Figure 5C:
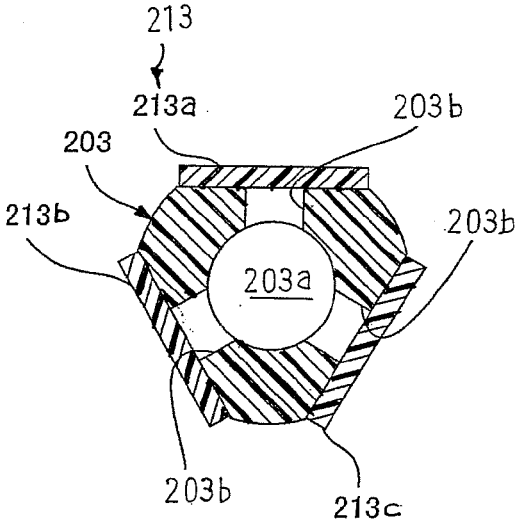
FIGS. 5C and 5D are cross sectional views showing the cross section of a sound tube and an associated active valve unit both incorporated in yet another insert earphone device of the present invention.
Figure 5D:
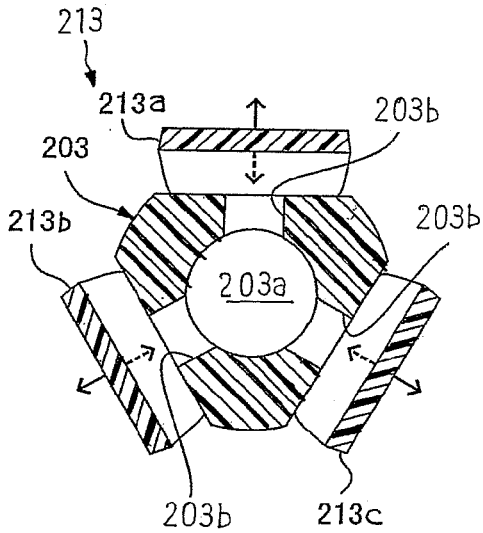

FIGS. 5C and 5D show an active valve unit 213 provided on flat outer surfaces of a sound tube 203. The sound tube 203 has a generally triangle cross section, and three flat outer surfaces extend in parallel to a centerline of the sound tube 203. The sound tube 203 is formed with a sound propagation hole 203*a* and three external sound entrances 203*b*. The sound propagation hole 203*a* extends in parallel to the centerline of sound tube 203, and is open to the outside at both sides thereof. The external sound entrances 203*b* are spaced from one another by 120 degrees, and are open at the inner ends thereof to the sound propagation hole 203*a* and at the outer ends thereof to the flat outer surfaces.

The active valve unit 213 has three leaf valves 213*a*, 213*b* and 213*c*, and the three leaf valves 213*a*, 213*b* and 213*c* are respectively provided on the three flat outer surfaces of sound tube 203. The three flat outer surfaces mean three flat areas of the outer surface of the sound tube 203. The leaf valves 213*a*, 213*b* and 213*c* are similar in structure and material to the leaf valves 210*a* and 210*b*, and are secured at one end portions thereof to the flat outer surfaces, respectively. The remaining portions of leaf valves 213*a*, 213*b* and 213*c* extend over the external sound entrances 203*b*, and the voltage supply line of cable is connected to the one end portions of leaf valves 213*a*, 213*b* and 213*c*.

While the voltage VLT in the opposite polarity is being applied to the leaf valves 213*a*, 213*b* and 213*c*, the remaining portions of leaf valves 213*a*, 213*b* and 213*c* are held in contact with the flat outer surfaces, and the external sound entrances 203*b* are closed with the leaf valves 213*a*, 213*b* and 213*c*, respectively, as shown in FIG. 5C.

When the applied voltage VLT is changed from the opposite polarity to the predetermined polarity, the leaf valves 213*a*, 213*b* and 213*c* are deformed, and the remaining portions are spaced from the flat outer surfaces of sound tube 203.

As a result, the environment is conducted through the external sound entrances 203*b* to the sound propagation hole 203*a* as shown in FIG. 5D.

Thus, although the sound tube 203 has the generally triangle cross section, the sound tube 203 and active valve unit 213 behave as similar to those of the second embodiment. The multiple external sound entrances 203*b* are preferable to the single external sound entrance 202*a*, because the multiple external entrances 203*b* cancel the directivity of external sound. From the viewpoint of cancellation of directivity, the three external sound entrances 203*b* are preferable to the two external sound entrances.

From the viewpoint of perfect closure of external sound entrances, it is desirable to provide a pad or pads on the active valve unit of the present invention. FIGS. 5E to 5N show leaf valves 214, 215, 216, 217 and 218 on sound tubes 204, 205, 206, 207 and 208 of insert earphone devices of the present invention. The leaf valves 214 to 218 serve as active valves, and are made of the electroactive polymer. Although the sound tubes 204, 205, 206, 207 and 208 have generally square column configurations, it is possible to give other configurations to the sound tubes 204 to 208. Moreover, although each of the sound tubes 204 to 208 is formed with a single external sound entrance 204*a*, 205*a*, 206*a*, 207*a* and 208*a*, more than one external sound entrance may be formed in the sound tubes 204 to 208.

Figure 5E:
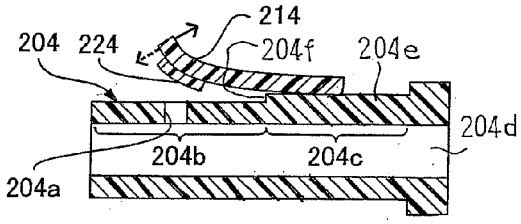
FIGS. 5E to 5N are cross sectional views showing various pads provided on leaf valves of other insert earphone devices of the present invention.
Figure 5F:
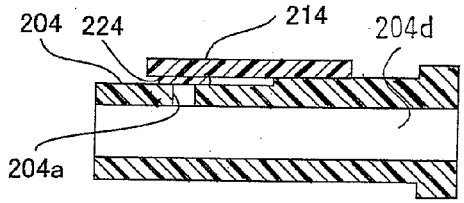

Referring first to FIGS. 5E and 5F, the sound tube 204 has two portions 204*b* and 204*c*, and a sound propagation hole 204*d* extends through both portions 204*b* and 204*d* in the longitudinal direction of sound tube 204. The portion 204*b* is connected to an electro-acoustic device (not shown), and the other portion 204*c* is connected to an inserting body (not shown). The external sound entrance 204*a* is formed in the portion 204*b*, and is open at one end thereof to the outer surface of portion 204*b* and at the other end thereof to the inner surface of portion 204*b*. Thus, the environment can be conducted to the sound propagation hole 204*d* through the external sound entrance 204*a*.

The portion 204*c* is formed with a land portion 204*e*, and an active valve unit 214 is fitted or secured to the land portion 204*e*. The land portion 204*e* has a flat surface, which is spaced from the outer surface of portion 204*b*, and a step 204*f* takes place between the portions 204*b* and 204*c*. The leaf valve 214 is similar in structure and material to the leaf valves 210*a* and 210*b*. The leaf valve 214 extends over the step 204*f*, and has a pad 224. The pad 224 is secured to the leading end portion of leaf valve 214 in such a manner as to be opposed to the external sound entrance 204*a*. The pad 224 is made of synthetic resin, and has a plate-like configuration. The synthetic resin for the pad 224 is softer than the conductive material for the electrodes 21*a*1 and 21*a*3. The pad 224 has thickness greater than the height of step 204*f*, and the lower surface of pad 224 is wider than the external sound entrance 205*a*. The pad 224 is so soft that the leaf valve 214 can tightly close the external sound entrance 204*a* with the pad 224.

While the voltage VLT is being applied to the leaf valve 214 in the opposite polarity, the leaf valve 214 presses the pad 224 to the outer surface of portion 204*b*, and closes the external sound entrance 204*a* with the pad 224 as shown in FIG. 5F. When the voltage VLT is changed from the opposite polarity to the predetermined polarity, the leaf valve 214 is deformed, and the pad 224 is spaced from the outer surface of portion 204*b*. Then, the external sound hole 204*a* is open to the environment, and permits the external sound to penetrate into the sound propagation hole 204*d* as shown in FIG. 5E.

Figure 5G:
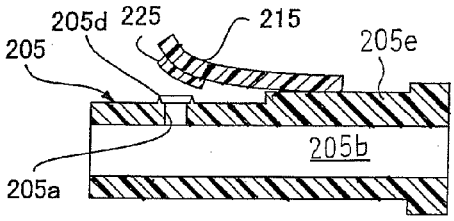
Figure 5H:
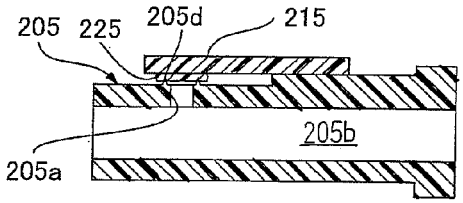

FIGS. 5G and 5H show the sound tube 205 and leaf valve 215. An external sound entrance and sound propagation hole are labeled with references 205*a* and 205*b*, respectively. The sound tube 205 is similar to the sound tube 204 except for a collar 205*d*. In detail, the leaf valve 215 is secured at one end portion thereof to a land portion 205*e* of sound tube 205, and a pad 225 is secured to the other end portion of leaf valve 215 at a suitable portion opposed to the external sound entrance 205*a*. The collar 205*d* has a ring shape, and is formed on the outer surface of sound tube 205 around the external sound entrance 205*d*. The ring-shaped collar 205 projects from the circumference of external sound entrance 205*d*, and has height less than the height of land portion 205*e*. The pad 225 has thickness greater than the difference in height between the lad portion 205*e* and the collar 205*d*. When the pad 225 is brought into contact with the collar 205*d*, the ridge of collar 205*d* sinks into the pad 225. For this reason, the external sound entrance 205*a* is tightly closed with the pad 225.

While the voltage VLT is being applied to the leaf valve 215 in the opposite polarity, the leaf valve 215 presses the pad 225 to the collar 205*d*, and tightly closes the external sound entrance 205*a* with the pad 225 as shown in FIG. 5H. When the voltage VLT is changed from the opposite polarity to the predetermined polarity, the leaf valve 215 is deformed, and the pad 225 is spaced from the collar 205*d*. Then, the external sound entrance 205*a* is open to the environment, and permits the external sound to penetrate into the sound propagation hole 205*b* as shown in FIG. 5G.

Figure 5I:
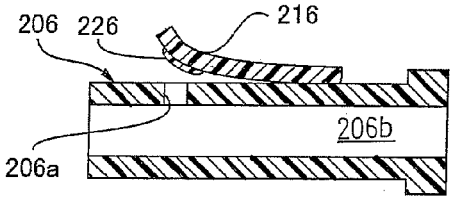
Figure 5J:
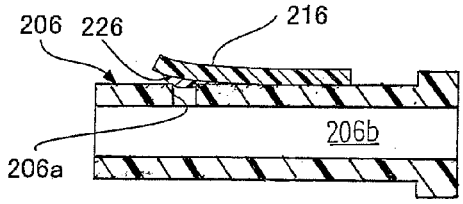

FIGS. 5I and 5J show the sound tube 206 and leaf valve 216. The sound tube 206 is formed with an external sound entrance 206*a* and a sound propagation hole 206*b*. However, any land portion is not formed in the sound tube 206. The leaf valve 216 is secured at one end portion thereof to the outer surface of sound tube 206, and the other end portion of leaf valve 216 extends over the external sound entrance 206*a*. A pad 226 is secured to the lower surface of the other end portion of sound tube 206, and is opposed to the external sound entrance 206*a*. The pad 226 has a round configuration like a part of an ellipsoid so that the bottom surface, which is held in contact with the lower surface of leaf valve 216, is elliptical. The pad 226 is made of synthetic resin, and is deformable.

While the voltage VLT is being applied to the leaf valve 216 in the opposite polarity, the leaf valve 216 presses the pad 226 to the circumference of external sound entrance 206*a*, and the pad 226 partially sinks into the external sound entrance 206*a* through resilient deformation thereof. Thus, the external sound entrance 206*a* is closed with the pad 226 as shown in FIG. 5J. When the voltage VLT is changed from the opposite polarity to the predetermined polarity, the leaf valve 216 is deformed, and the pad 226 is spaced from the circumference of external sound entrance 206*a*. Then, the external sound entrance 206*a* is open to the environment, and permits the external sound to penetrate into the sound propagation hole 206*b* as shown in FIG. 5I.

Figure 5K:
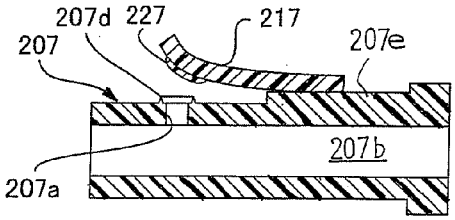
Figure 5L:
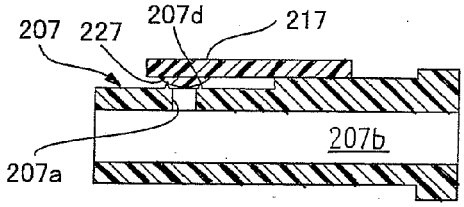

FIGS. 5K and 5L show the sound tube 207 and leaf valve 217. The sound tube 207 is similar in configuration to the sound tube 205 so that an external sound entrance 207*a*, sound propagation hole 207*b*, a collar 207*d* and a land portion 207*e* are formed in and on the sound tube 207. On the other hand, leaf valve 217 is similar in configuration to the leaf valve 216 so that a pad, which has a round configuration like a part of an ellipsoid, is secured to the lower surface of a leading portion of the leaf valve 216.

When the voltage VLT is applied to the leaf valve 217 in the opposite polarity, the leaf valve 217 is straightened, and presses the pad 227 to the collar 207*d*. The ridge of collar 207*d* makes inroad into the pad 227. Thus, the external sound entrance 206*a* is closed with the pad 226 as shown in FIG. 5L.

When the voltage VLT is changed from the opposite polarity to the predetermined polarity, the leaf valve 217 is deformed, and the pad 227 is spaced from the collar 207*d*. Then, the external sound entrance 207*a* is open to the environment, and permits the external sound to penetrate into the sound propagation hole 207*b* as shown in FIG. 5K.

Figure 5M:
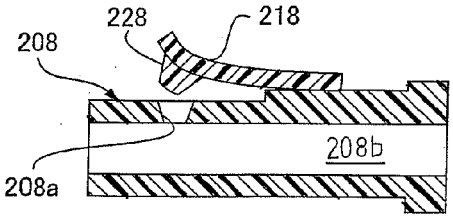
Figure 5N:
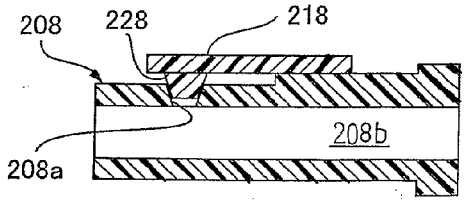

FIGS. 5M and 5N show the sound tube 208 and leaf valve 218. The sound tube 208 is similar in to the sound tube 204 so that an external sound entrance 209*a* and a sound propagation hole 208*b* are formed. However, the external sound entrance 208*a* is different in configuration from the other external sound entrances 204*a*, 205*a*, 206*a* and 207*a*. The external sound entrance 208*a* is increased in circular cross section from the sound propagation hole 208*b* to the outer surface of sound tube 208. On the other hand, a pad 228, which is secured to the leaf valve 218, is different from the pads 224, 225, 226 and 227. The pad 228 is formed of the synthetic resin, and the pad 228 is shaped into a frustum of cone so as to be decreased in circular cross section from the lower surface of leaf valve 218 to the leading end. The gradient of external sound entrance 208*a* is approximately equal to the gradient of pad 228. However, the area of inner opening and depth of external sound entrance 208*a* are less than the area of inner opening and thickness of pad 228. For this reason, when the pad 228 is received in the external sound entrance 208*a*, the side surface of pad 228 is tightly brought into contact with the inner surface of sound tube defining the external sound entrance 208*a*. Thus, the external sound entrance 208*a* is plugged with the pad 228.

While the voltage VLT is being applied to the leaf valve 228 in the opposite polarity, the leaf valve 218 is straightened, and makes the pad 226 penetrate into the external sound entrance 208*a*. The side surface of pad 228 is tightly held into contact with the inner surface defining the external sound entrance 208*a*. As a result, the external sound entrance 208*a* is closed with the pad 228 as shown in FIG. 5N. When the voltage VLT is changed from the opposite polarity to the predetermined polarity, the leaf valve 218 is deformed, and the pad 228 is spaced from the circumference of external sound entrance 208*a*. Then, the external sound entrance 208*a* is open to the environment, and permits the external sound to penetrate into the sound propagation hole 208*b* as shown in FIG. 5M.

The frustum of cone does not set any limit to the pad 228. A pad may have another frustum configuration or yet another three-dimensional configuration in so far as an external sound entrance has a corresponding configuration.

The collar 205*d* and 207*d* may be formed on the leaf valves 215 and 217 without or together with the pads 225 and 227.

Moreover, a feedback controller may be connected between the active valves 21, 210, 211, 213 and 214 to 218 and the associated controller. In this instance, the feedback controller monitors the active valve 21, 210, 2111, 213 or one of 214 to 218 for the force exerted on the associated sound tube or collar, and varies the voltage VLT in such a manner as to keep the force constant.

Another insert earphone device may be equipped with a control dial or lever for changing the voltage VLT. In this instance, the user can control the gap between the active valve and the sound tube so as to regulate the volume of external sound to his or her favorite level.

The cable L2 does not set any limit to the technical scope of the present invention. In order words, the electric coupling may be implemented by a radio channel EM as shown in FIG. 6.

Figure 6:
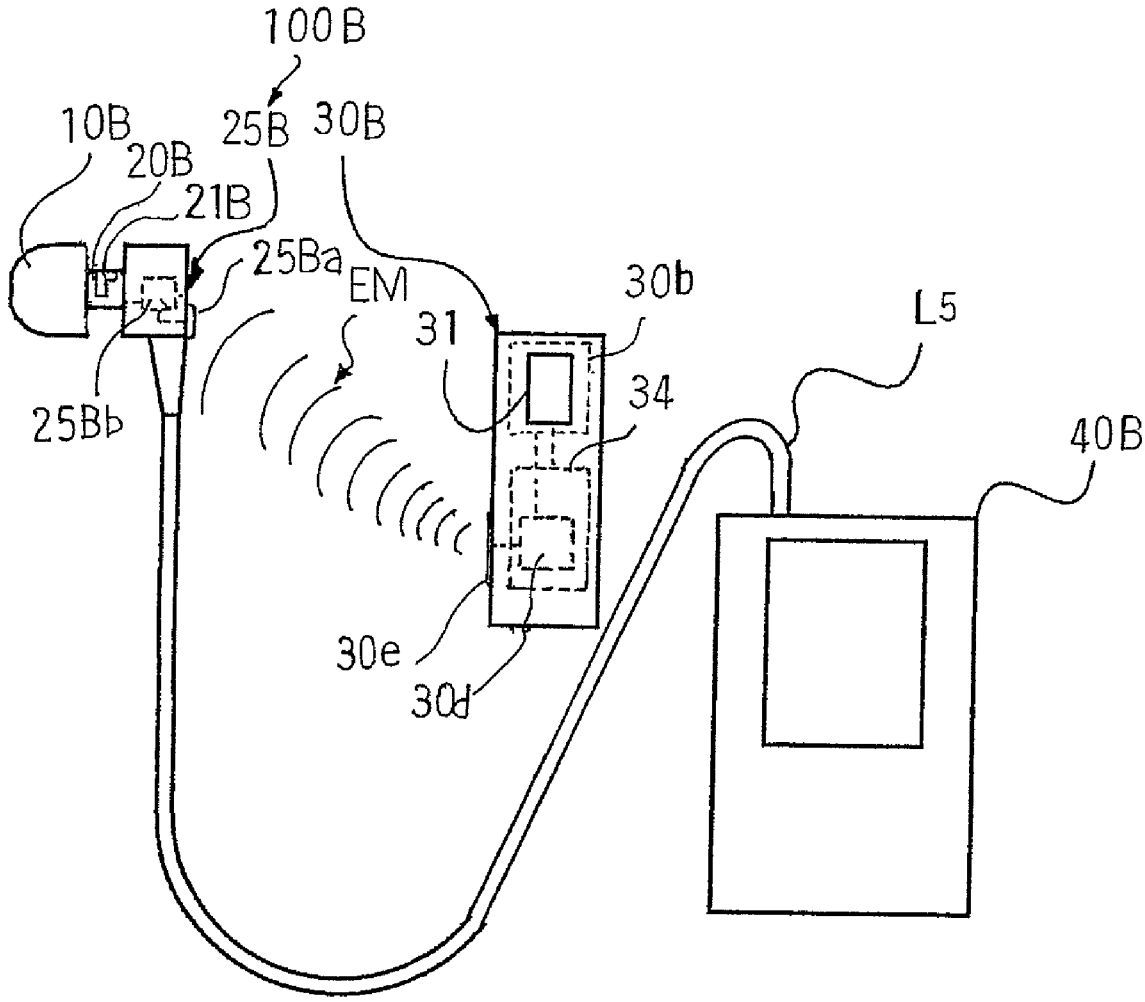
FIG. 6 is a schematic front view showing the external appearance of another portable music player according to the present invention.

FIG. 6 shows an insert earphone device 100B and a sound signal generator 40B, which is connected through a cable L1 to the insert earphone device 100B. The insert earphone device 100B includes an inserting body 10B, a sound tube 20B, an active valve unit 21B, an electro-acoustic device 25B, a controller 30B and a cable L5. The electro-acoustic device 25B is connected to the portable sound signal generator 40B through the cable L5 and signal propagation path inside the controller 30B as similar to the electro-acoustic device 25B.

The insert body 10B, sound tube 20B and active valve unit 21B are similar to those of the insert earphone device 100 so that no further description is hereinafter incorporated for the sake of simplicity. The electro-acoustic device 25B and controller 30B are different from the electro-acoustic device 25 and controller 30 in that a radio communication system is incorporated therein. However, other features of electro-acoustic device 25B and other features of controller 30B are similar to those of the electro-acoustic device 25B and those of the controller 30B. Other component parts of controller 30B are labeled with the references designating the corresponding component parts of controller 30 without detailed description for the sake of simplicity.

A transmitter 30*d* is incorporated in the electronic system on the circuit board 30*b*, and is connected to an antenna 30*e*. The control signal, which is indicative of the polarity of voltage VLT, is supplied to the transmitter 30*d*, and rides on a high-frequency carrier signal. The radio-frequency control signal is supplied from the transmitter 30*d* to the antenna 30*e*, and is radiated from the antenna 30*e*. On the other hand, a DPDT switch (not shown), an antenna 25Ba and a receiver 25Bb are incorporated in the electro-acoustic device 25B. The antenna 25Ba receives the radio-frequency control signal, and the radio-frequency control signal is retrieved to the control signal and electric power through the receiver 25Bb. The electric power is supplied to the DPDT switch, and the polarity of voltage is changed between the predetermined polarity and the opposite polarity through the DPDT switch. Thus, the electric coupling is established between the controller 30B and the electro-acoustic device 25B through the radio channel EM.

The controller 30, which is connected to between the insert earphone device and 10/20/25 and the portable sound signal generator 40, does not set any limit to the technical scope of the present invention. A battery of the sound signal generator is available for the active valve unit, the DPDT switch 35 and/or electronic system may form parts of the sound signal generator or the electro-acoustic device.

Figure 7:
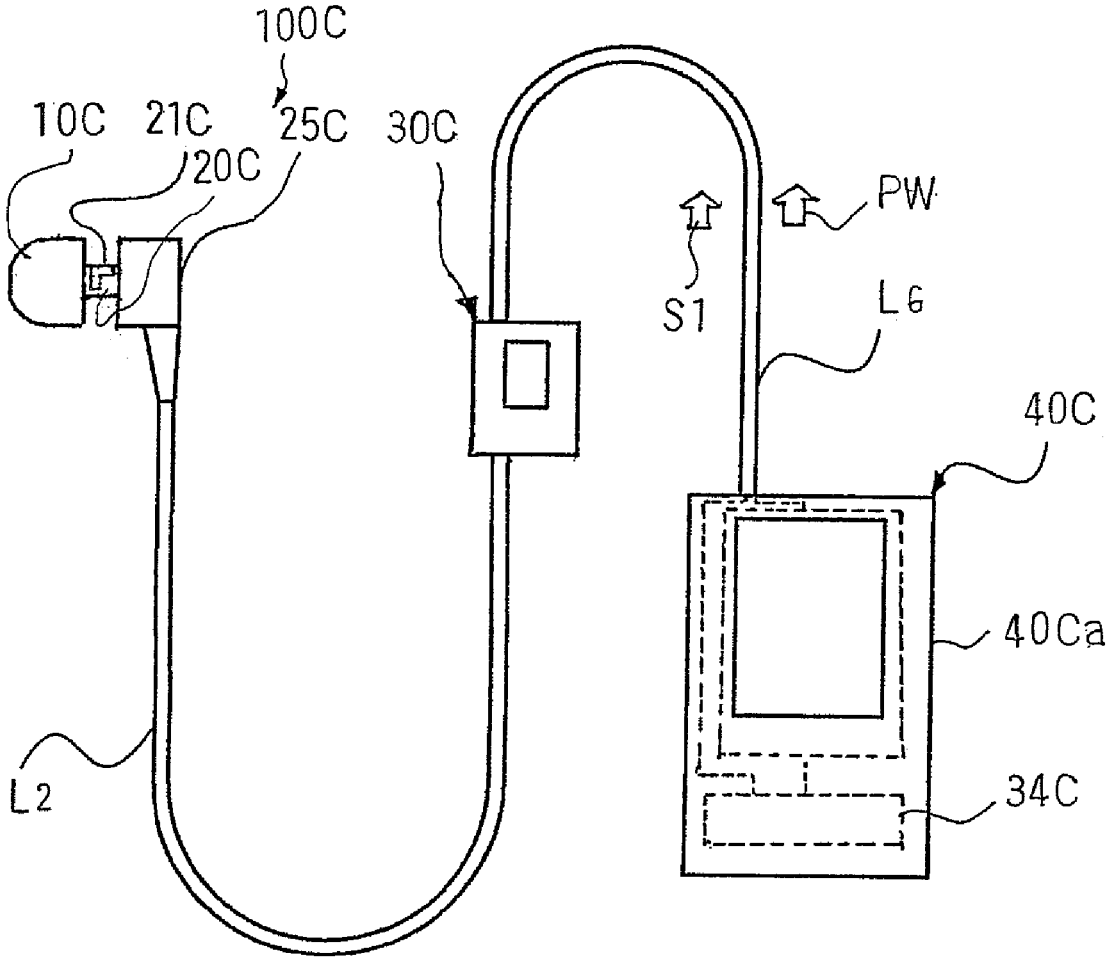
FIG. 7 is a front view showing the external appearance of yet another portable music player of the present invention.

FIG. 7 shows an insert earphone device 100C and a portable sound signal generator 40C, which is connected to the insert earphone device 100C through a cable L6. The insert earphone device 100C includes an inserting body 10C, a sound tube 20C, an active valve unit 21C, an electro-acoustic device 25C and a controller 30C. The inserting body 10C, sound tube 20C, active valve unit 21C and electro-acoustic device 25C are similar to the inserting body 10, sound tube 20, active valve unit 21 and electro-acoustic device 25, and, for this reason, no further description is hereinafter incorporated for the sake of simplicity.

The controller 30C is different from the controller 30 in that the battery unit 35 is not incorporated in the controller 30C. A battery 34C, which is provided inside a case 40Ca of the sound signal generator 40C, is shared between the controller 30C and the sound signal generator 40C. The Not only the sound signal S1 but also electric power PW are propagated from the sound signal generator 40C to the controller 30C through the cable L6.

Figure 8:
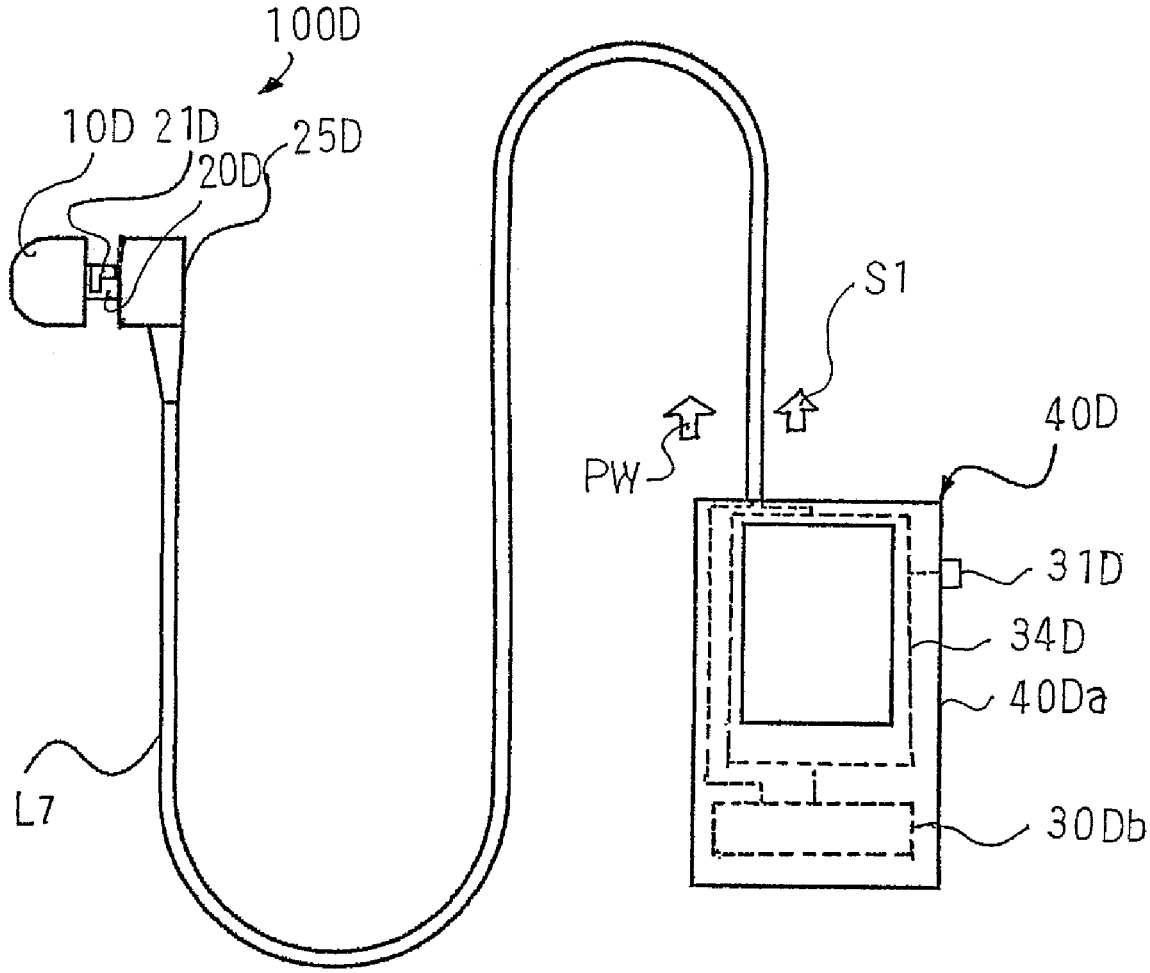
FIG. 8 is a front view showing the external appearance of still another portable music player of the present invention.

FIG. 8 shows an insert earphone device 100D and a portable sound signal generator 40D, which is connected to the insert earphone device 100D through a cable L7. The insert earphone device 100D includes an inserting body 10D, a sound tube 20D, an active valve unit 21D and an electro-acoustic device 25D. The inserting body 10D, sound tube 20D, active valve unit 21D and electro-acoustic device 25D are similar to the inserting body 10, sound tube 20, active valve unit 21 and electro-acoustic device 25, and, for this reason, no further description is hereinafter incorporated for the sake of simplicity. An electronic system 30Db, which is equivalent to the electronic system on the circuit board 30*b*, is provided inside a case 40Da of the sound signal generator 40D, and a button switch 31D, which is equivalent to the button switch 31, is provided on the case 31D. The electronic system 30Db may be implemented by the electronic system for producing the sound signal S1. A battery unit 34D is provided inside the case 40Da, and is shared with the sound signal generator 40D. Thus, the insert earphone device 100D is provided for users without any controller independent of the sound signal generator 40D.

Figure 9:
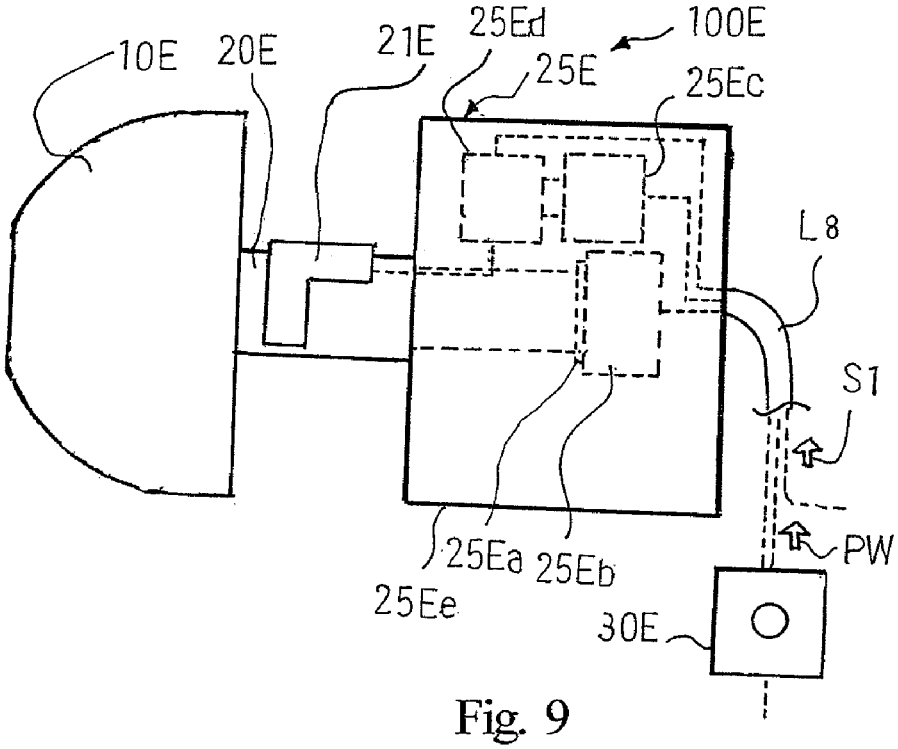
FIG. 9 is a front view showing an insert earphone device of the present invention.

FIG. 9 shows an insert earphone device 100E of the present invention. The earphone device 100E includes an inserting body 10E, a sound tube 20E, an active valve unit 21E, an electro-acoustic device 25E, a cable L8 and a controller 30E. The inserting body 10E, sound tube 20E and active valve unit 21E are similar to the inserting body 10, sound tube 20 and active valve unit 21 so that detailed description on these component parts are omitted for the sake of simplicity. The controller 30E is implemented by a switch box, and is connected to the electro-acoustic device 25E. The sound signal S1 is propagated from a sound signal generator (not shown) to the electro-acoustic device 25E through another conductive line of the cable L8.

The electro-acoustic device 25E includes a diaphragm 25Ea, an exciter 25Eb, an electronic system 25Ec, a DPDT switch 25Ed and a case 25Ee. The diaphragm 25Ea, exciter 25Eb, electronic system 25Ec and DPDT switch 25Ed are housed in the case 25Ee, and the conductive lines of cable L8 are connected to the exciter 25Eb and DPDT switch 25Ed, respectively. A sound of electric power (not shown) is provided outside of the electro-acoustic device 25E, and the electric power PW is supplied from the source of electric power through the cable L8. A battery unit, i.e., the source of electric power may be provided inside the controller 30E.

The sound signal S1 is supplied to the exciter 25Eb, and the exciter 25Eb gives rise to vibrations of the diaphragm 25Ea. The diaphragm 25Ea generates sound waves in the sound propagation path in the sound tube 20E, and the sound waves are propagated to the external auditory meatus through the inserting body 10E.

The electronic system 25EC and DPDT switch 25Ed are similar to the electronic system on the circuit board 30*b* and DPDT switch 35, and the voltage VLT is applied through the DPDT switch 25Ed to the active valve unit 21E. Thus, the voltage VLT is changed between the predetermined polarity and the opposite polarity in the electro-acoustic device 25E.

Figure 10:
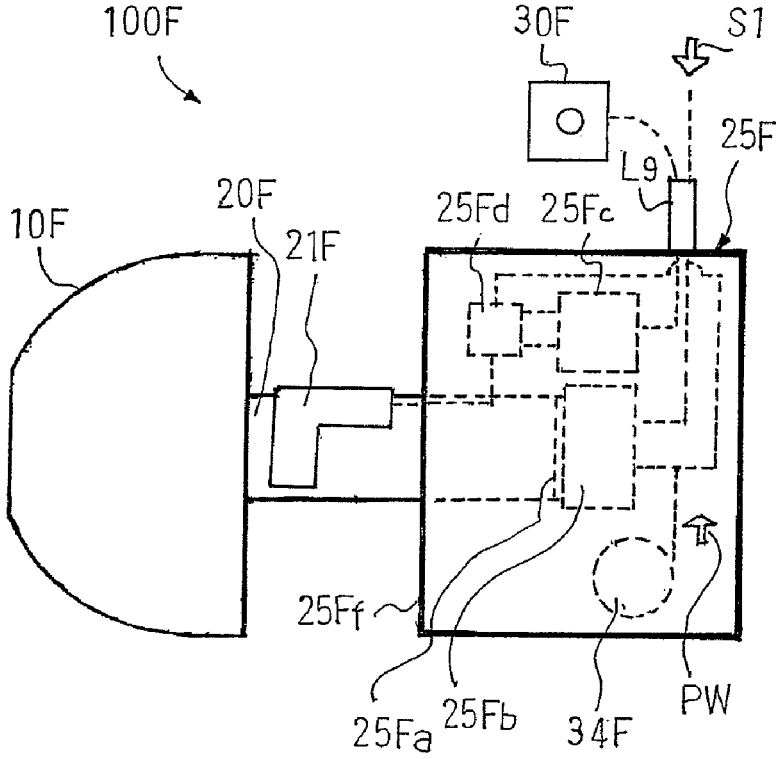
FIG. 10 is a front view showing another insert earphone device of the present invention.

FIG. 10 shows an insert earphone device 100F, which includes an inserting body 10F, a sound tube 20F, an active valve unit 21F, an electro-acoustic device 25F, a controller 30F and a cable L9. The inserting body 10F, sound tube 20F and active valve unit 21F are similar to the inserting body 10, sound tube 20 and active valve unit 21 so that detailed description is omitted for the sake of simplicity.

The electro-acoustic device 25F is different from the electro-acoustic device in that not only a diaphragm 25Fa, an exciter 25Fb, an electronic system 25Fc and a DPDT switch 25Fd but also a battery cell 34F are housed in a case 25Ff of the electro-acoustic device 25F. Thus, the battery cell 34F, electronic system 25Fc and DPDT switch 25Fd are provided inside the case 25Ff. Electric power PW is supplied from the battery cell 34F to the DPDT switch 25Fd, and the voltage VLT is changed between the predetermined polarity and the opposite polarity under the control of the electronic system 25Fc. The controller 30F is implemented by a switch box, and the DPDT switch 25Fd makes the voltage VLT changed in polarity in response to manipulation on the switch box 30F.

Figure 11:
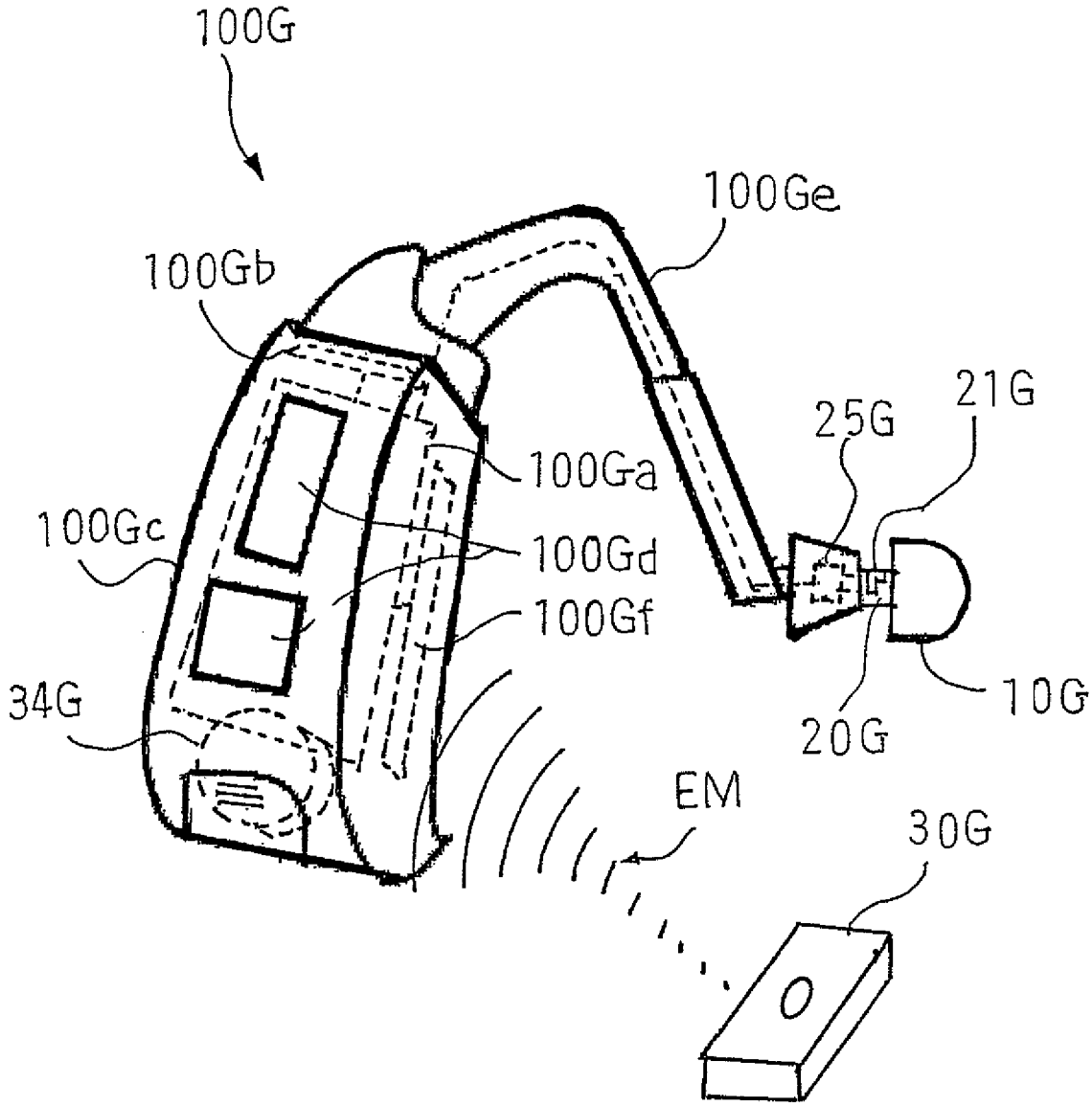
FIG. 11 is a perspective view showing a hearing aid of the present invention.

The sound signal generator 40 does not set any limit to the technical scope of the present invention. FIG. 11 shows a hearing aid or an ear aid 100G. The ear aid 100G includes an electric circuit 100Ga, a microphone 100GB, a housing 100GC, switches 100Gd, an ear hook 100Ge, an antenna 100Gf, a battery cell 34G, an electro-acoustic device 25G, an inserting body 10G, a sound tube 20G, an active valve unit 21G and a change-over switch box 30G. The microphone 100Gb and antenna 100Gf are connected to the electric circuit 100Ga, which has circuitries required for controlling input voice and communication with the change-over switch box 30G, and the battery cell 34G supplies electric power to the electric circuit 100Ga. The electric circuit 100Ga, antenna 100Gf and battery cell 34G are provided inside the housing 100Gc, and the microphone 100Gb and switches 100Gd are exposed to the outside of the housing 100Gc. The housing 100GC is connected through the ear hook 100Ge to the electro-acoustic device 25G, which in turn is connected to the inserting body 10G through the sound tube 20G. The active valve unit 21G is provided on the sound tube 20G, and the electro-acoustic device 25G and active valve unit 21G are connected to the electric circuit 100Ga. Users regulate the volume and tone quality to appropriate values by means of the switches 100Gd. The electric circuit 40La for the voice control and communication with the change-over switch box 30G are well known to persons skilled in the art, and the inserting body 10G and active valve unit 21G are similar to the inserting body 10 and active valve unit 21G.

When a user requires the ear aid for conversation with a person, the user puts the ear hook 100Ge behind the external ear EE, and inserts the inserting body 10G into the external auditory meatus EA. The voice is input through the microphone 100Gb to the electric circuit 100Ga, and the audio signal representative of the voice is supplied from the electric circuit 100Ga to the electro-acoustic device 25G. The audio signal is converted to the internal sound through the electro-acoustic device 25G, and the internal sound is radiated from the sound propagation path to the external auditory meatus EA of user. While the user is talking to the person, he or she may close the external sound entrance with the active diaphragm 21G. In this situation, the potential in the predetermined polarity is supplied to the active valve unit 21G. When the user wishes to hear environmental sound without any aid, he or she pushes the button switch of change-over control box 30G. Then, the electromagnetic waves EM are radiated from the change-over switch box 30G. The electromagnetic waves EM are received through the antenna 100Gf, and the electromagnetic waves are converted to a control signal. The control signal is supplied to the electric circuit 100Ga, and the potential in the opposite polarity is supplied to the active valve unit 21G. The active valve unit 21G is warped, and the environmental sound enters the external auditory meatus EA of user through the external sound entrance.

The polarity of voltage VLT may be changed by means of a logic circuit. The logic circuit includes a one-shot pulse generator and a flip flop, by way of example. The one-shot pulse generator is connected to the button switch 31, and the flip flop is connected to the one-shot pulse generator. The DPDT switch is controlled through the flip flop. Thus, the computer program does not set any limit to the technical scope of the present invention.

The insert earphone devices 100 to 100F do not set any limit to the technical scope of the present invention. The present invention may appertain to a headphone. The headphone has at least ear pad, which is brought into contact with an external ear of a human being. Therefore, the inserting body is not an indispensable element of the present invention.

The change of polarity does not set any limit to the technical scope of the present invention. An active valve unit, which is made of the electroactive polymer, may keep itself straight without any application of voltage, and deformed in the present of voltage.

The pad 224, 225, 226 or 227 may be secured to the active valve unit 212, which is provided inside the sound tube 202.

The collar 205*d* or 207*d* may be formed on the inner surface of sound tube defining the sound propagation hole 205*b* or 207*b*. In this instance, the active leaf valve 215 or 217 is provided inside the sound tube 205 or 207, and pad 224 or 227 is secured to the active leaf valve 215 or 217.

The MD disc 40*a* does not set any limit to the technical scope of the present invention. A CD (Compact Disc) may be loaded in a CD music player, and a cassette tape may be loaded in a cassette tape player.

Although the sheet 21*a*2 of electroactive polymer is perfectly sandwiched between the conductive electrodes 21*a*1 and 21*a*2 in FIG. 3A, a sheet of electroactive polymer of an active valve unit may be partially uncovered with the conductive electrodes.

The component parts of insert earphone devices 100 to 100F and the component parts of ear aid 100G are correlated with claim languages as follows. The portable sound signal generator 40, MD player 40A, sound signal generators 40B, 40C and 40D and ear aid 100G except for the inserting body 10G, sound tube 20G, active valve unit 21G and signal-to-sound converter 25G serve as a "source of sound signal", and the controller 30, 30B or 30G except for the button switch 31 or 31D, the combination of controller 30A or 30C except for the button switch 31*a* and battery unit 41 or 34C, the combination of battery unit 34D and electronic system 30Db are corresponding to a "source of voltage."

The inserting body 10, 10A, 10B, 10C, 10D, 10E, 10F or 10G, sound tubes 20, 200, 201, 202, 203, 204, 205, 206, 207, 208, 20B, 20C, 20D, 20E, 20F or 20G, active valve unit 21, 210, 211, 213, 214, 215, 216, 217, 218, 21B, 21C, 21D, 21E, 21F or 21G, electro-acoustic device 25, 25A, 25B, 25C, 25D, 25E, 25F or 25G, button switch 31, 31*a* or 31D and cable/radio channel L2, L4, L6, L7, L8, L9 or EM form in combination an "earphone device."

The inserting body 10, 10A, 10B, 10C, 10D, 10E, 10F or 10G serves as "an ear coupler", and the sound tubes 20, 200, 201, 202, 203, 204, 205, 206, 207, 208, 20B, 20C, 20D, 20E, 20F or 20G is corresponding to "a sound tube." Though not shown in the drawings, the present invention appertains to a headphone, and the ear pads and hair band serve as the "ear coupler."

The active valve unit 21, 210, 211, 213, 214, 215, 216, 217, 218, 21B, 21C, 21D, 21E, 21F or 21G serves as "an active valve unit", and the electro-acoustic device 25, 25A, 25B, 25C, 25D, 25E, 25F or 25G is corresponding to "a signal-to-sound converter", and the cable/radio channel L2, L4, L6, L7, L8, L9 or EM serves as "an electric coupling."

The sound signal S1 is corresponding to "a sound signal", and the voltage VLT is corresponding to "voltage". Term "sound" means both of the external sound and internal sound. If the term "sound" is modified with "internal" and "external", the "internals sound" and "external sound" are corresponding to the internal sound and the external sound, respectively.

The sound propagation hole 10*d* is corresponding to "a first sound propagation path", and the sound propagation hole 20*b*, 200*b*, 201*c*, 202*b*, 203*a*, 204*d*, 205*d*, 206*d*, 207*d* or 208*d* serves as "a second sound propagation path" and "a sound propagation path" in claims, which define a sound tube. The external sound entrance or external sound entrances 20*c*, 200*c*, 201*a*, 202*a*, 203*b*, 204*a*, 205*a*, 206*a*, 207*a* or 208*a* serve as "an external sound entrance".

The connecting portion 21*b* is corresponding to "a part of said active valve unit", and the valve body 21*a* is corresponding to "another part of said active valve unit." The leaf valves 210*a* and 210*b*, 211*a* and 211*b*, 213*a*, 213*b* and 213*c*, 214, 215, 216, 217 or 218 or the active valve unit 212, 21B, 21C, 21D, 21E, 21F or 21G serve partially as "a part of said active valve unit" and partially as "another part of said active valve unit."

Each of the external sound entrances 203*b* serves as one of "plural through-holes", by way of example, and each of the leaf valves 213*a*, 213*b* and 213*c* is corresponding to one of "plural deformable portions."

The flat surfaces of sound tube 213 are, by way of example, corresponding to "plural flat areas", and the flat inner surfaces 202*c* serves as "an inner surface defining said second sound propagation path."

The pad 224, 225, 226, 227 or 228 is corresponding to "a pad", and the collar 205*d* or 207*d* serves as "a collar." The frustum of cone is equivalent to "a configuration" of the external sound entrance and "a configuration" of the pad. The sheet of electroactive polymer 21*a*2 is corresponding to "a layer" of the electroactive polymer.

What is claimed is:

1. An earphone device connected to a source of sound signal for sending out sound into at least one external ear of a human being, comprising:

a signal-to-sound converter converting a sound signal to internal sound;

an ear coupler engaged with said at least one external ear of said human being, and formed with a first sound propagation path open at one end thereof to said at least one external ear so that external sound and said internal sound are sent out into said external ear of said human being;

a sound tube connected between said signal-to-sound converter and said ear coupler, and formed with a second sound propagation path connected at one end thereof to the other end of said first sound propagation path and at the other end thereof to said signal-to-sound converter so that said internal sound is propagated from said signal-to-sound converter to said first sound propagation path, said sound tube being further formed with an external sound entrance open at one end thereof to environment and at the other end thereof to said second sound propagation path;

an active valve unit supported by said sound tube and responsive to voltage supplied from a source of voltage so as to be deformed for closing said external sound entrance therewith and permitting said environment to be conducted to said second sound propagation path through said external sound entrance; and an electric coupling connected to said active valve unit and supplying said voltage to said active valve unit.

2. The earphone device as set forth in claim 1, in which said sound tube has an outer surface, and a part of said active valve unit is secured to said outer surface of said sound tube in such a manner that said external sound entrance is closed with another part of said active valve unit.

3. The earphone device as set forth in claim 2, in which said sound tube has an annular cross section, and said another part of said active valve unit have a sectoral cross section.

4. The earphone device as set forth in claim 2, in which said external sound entrance is formed by plural through-holes, and said active valve unit has plural deformable portions assigned to said plural through-holes, respectively.

5. The earphone device as set forth in claim 4, in which said sound tube has plural flat areas in said outer surface of said sound tube, and said plural through-holes are respectively open to said plural flat areas, thereby permitting said active valve unit to close and open said through-holes with said deformable portions, respectively.

6. The earphone device as set forth in claim 1, in which said sound tube has an inner surface defining said second sound propagation path, and said active valve unit is secured to said inner surface of said sound tube in such a manner that said external sound entrance is closed with and opened by said active valve unit.

7. The earphone device as set forth in claim 1, in which said active valve unit has a pad formed of a sort of material softer than another sort of material of said active valve unit, and said external sound entrance is closed with said pad.

8. The earphone device as set forth in claim 7, in which said sound tube is formed with a collar around said external sound entrance so that said pad is pressed to said collar while said external sound entrance is closed with said active valve unit.

9. The earphone device as set forth in claim 7, in which said external sound entrance has a configuration corresponding to the configuration of said pad, and is plugged with said pad.

10. The earphone device as set forth in claim 1, in which said active valve unit has a layer of electroactive polymer deformable under the condition that said voltage is applied thereto.

11. The earphone device as set forth in claim 10, in which said layer of electroactive polymer is differently deformed depending upon polarity of said voltage.

12. A sound tube connected between a signal-to-sound converter and an ear coupler and formed with a sound propagation path open at one end thereof to said signal-to-sound converter and at the other end thereof to said ear coupler so that sound is sent out through said ear coupler to an external ear of a human being, said sound tube being further formed with an external sound entrance open at one end thereof to environment and at the other end thereof to said sound propagation path, wherein said sound tube has a portion for supporting an active valve unit, which is responsive to voltage supplied from a source of voltage through an electric coupling so as to be deformed for closing said external sound entrance therewith and permitting said environment to be conducted to said sound propagation path through said external sound entrance.

13. The sound tube as set forth in claim 12, in which said active valve unit has a portion secured to an area of an outer surface of said sound tube and another portion deformed so that said external sound entrance is closed with said another portion of said active valve unit and opened for permitting said environment to be conducted to said sound propagation path.

14. The sound tube as set forth in claim 12, in which said sound propagation path is defined by an inner surface of said sound tube, and said active valve unit is secured at a portion thereof to said inner surface in such a manner that said external sound entrance is closed with another portion of said active valve unit.

15. The sound tube as set forth in claim 12, in which a deformable pad is secured to a portion of said active valve unit, and penetrates into said external sound entrance when said external sound entrance is closed with said active valve unit.

16. A sound generating apparatus for supplying sound to a human being, comprising:

a source of sound signal for producing a sound signal;

a source of voltage for generating voltage; and an earphone device connected to said source of sound signal and said source of voltage for sending out sound into at least one external ear of said human being, and including a signal-to-sound converter converting said sound signal to internal sound, an ear coupler engaged with said at least one external ear of said human being and formed with a first sound propagation path open at one end thereof to said at least one external ear so that external sound and said internal sound are sent out into said external ear of said human being and a sound tube connected between said signal-to-sound converter and said ear coupler and formed with a second sound propagation path connected at one end thereof to the other end of said first sound propagation path and at the other end thereof to said signal-to-sound converter so that said internal sound is propagated from said signal-to-sound converter to said first sound propagation path, said sound tube being further formed with an external sound entrance open at one end thereof to environment and at the other end thereof to said second sound propagation path, an active valve unit supported by said sound tube and responsive to voltage so as to be deformed for closing said external sound entrance therewith and permitting said environment to be conducted to said second sound propagation path through said external sound entrance, and an electric coupling connected between said source of voltage and said active valve unit for supplying said voltage to said active valve unit.

17. The sound generating apparatus as set forth in claim 16, in which said source of sound signal is a music player for producing said sound signal from pieces of music data stored in a music information storage medium.

18. The sound generating apparatus as set forth in claim 16, in which said sound of sound signal is an ear aid for enlarging loudness of said external sound.

19. The sound generating apparatus as set forth in claim 16, in which said electric coupling is formed by a cable connected between said source of voltage and said active valve unit.

20. The sound generating apparatus as set forth in claim 16, in which said active valve unit has a layer of electroactive polymer deformable under application of said voltage.

* * * * *